US007004737B2

(12) United States Patent
Russell

(10) Patent No.: US 7,004,737 B2
(45) Date of Patent: Feb. 28, 2006

(54) METHODS AND APPARATUS FOR FORMING CONCRETE STRUCTURES

(76) Inventor: Matthew Russell, 4408 Elderberry, Spokane, WA (US) 99208

( * ) Notice: Subject to any disclaimer, the term of this patent is extended or adjusted under 35 U.S.C. 154(b) by 206 days.

(21) Appl. No.: 10/131,838

(22) Filed: Apr. 25, 2002

(65) Prior Publication Data

US 2003/0034576 A1 Feb. 20, 2003

Related U.S. Application Data

(60) Provisional application No. 60/313,538, filed on Aug. 20, 2001.

(51) Int. Cl.
*E04G 11/04* (2006.01)
*E04G 11/20* (2006.01)

(52) U.S. Cl. ..... 425/63; 249/20; 264/33

(58) Field of Classification Search ..... 425/63, 425/64, 65; 264/33; 249/20
See application file for complete search history.

(56) References Cited

U.S. PATENT DOCUMENTS 3,552,709 A * 1/1971 Svensson ..... 249/20
3,871,612 A 3/1975 Weaver ..... 249/184
3,901,472 A * 8/1975 Ahlgren ..... 249/20
4,253,810 A * 3/1981 Bezhanov et al. ..... 425/64
4,915,345 A 4/1990 Lehmann ..... 249/18
5,125,617 A 6/1992 Miller ..... 249/18
5,241,797 A 9/1993 Cliff ..... 52/192
5,492,303 A * 2/1996 Jaruzel ..... 249/4

* cited by examiner

*Primary Examiner*—Donald Heckenberg
(74) *Attorney, Agent, or Firm*—John S. Reid

(57) ABSTRACT

An apparatus for forming concrete structures includes a first truss module and a second truss module, as well as a first and a second concrete form. The apparatus further includes a first and a second actuator device. Each first and second actuator device is mounted on the respective first and second truss module, and each first and second actuator device can move the respective first and second form translationally with respect to the respective first and second truss module. A yoke connects the first truss module to the second truss module to thereby place the concrete forms in generally parallel, spaced-apart relationship. A climbing device attached to the yoke can engage a climb rod and can move the apparatus upward along the climb rod.

21 Claims, 21 Drawing Sheets

FIG. 17A
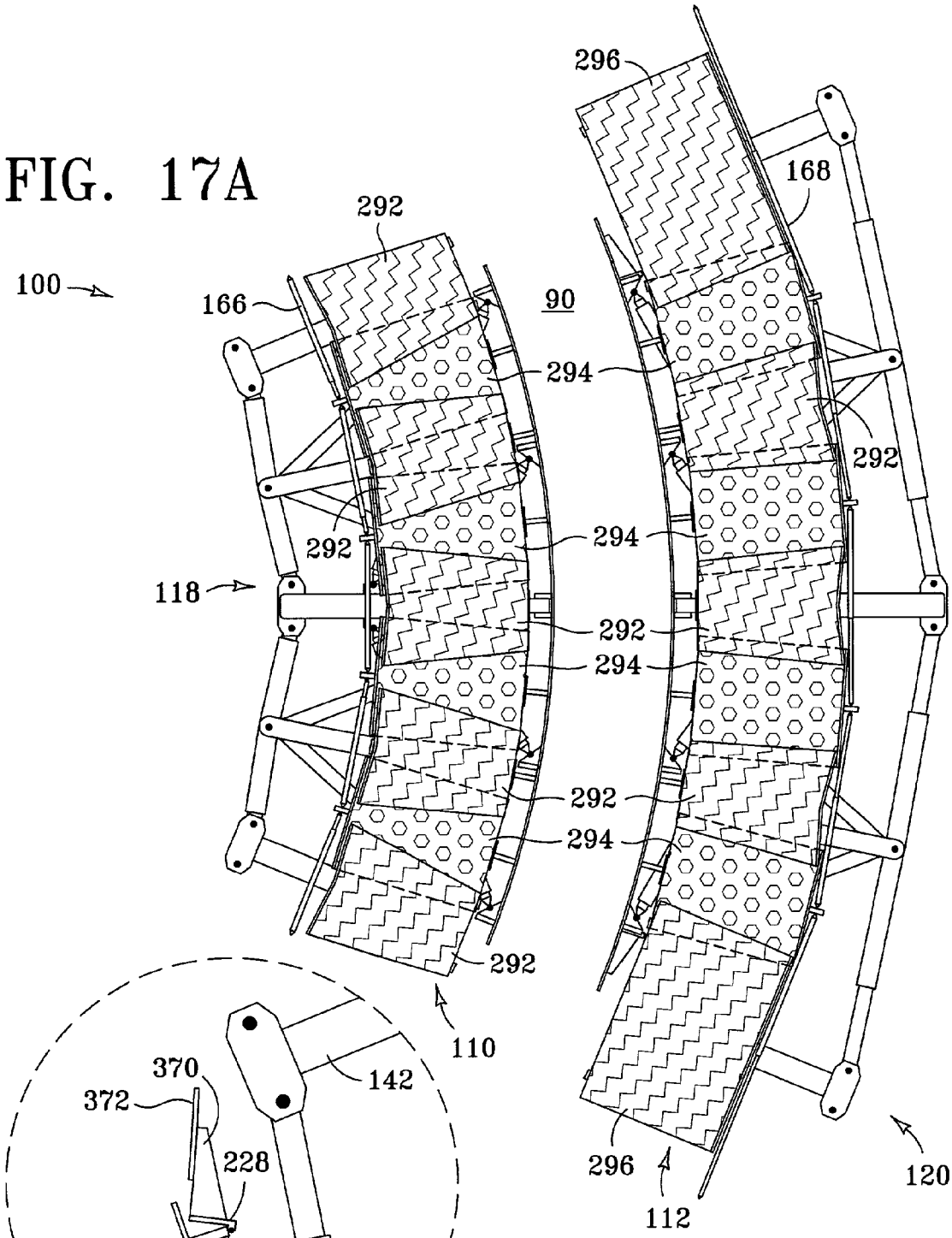
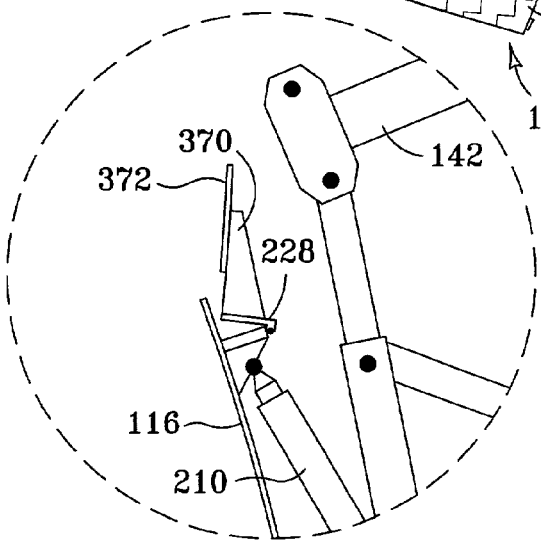
FIG. 17B

METHODS AND APPARATUS FOR FORMING CONCRETE STRUCTURES

CROSS REFERENCE TO RELATED APPLICATIONS

The present invention claims priority under 35 U.S.C. §120 to U.S. Provisional Patent Application Ser. No. 60/313,538, filed Aug. 20, 2001 and hereby incorporated herein by reference in its entirety.

FIELD OF THE INVENTION

The invention claimed and disclosed herein pertains to apparatus and methods for forming concrete structures, and in particular to methods and apparatus for forming vertical or near-vertical concrete structures.

BACKGROUND OF THE INVENTION

This invention pertains to methods and apparatus for constructing vertically, oriented, or near-vertical, concrete structures. "Near-vertical" means that the structure, or segments of whole structures, can be purposely constructed at a slope (or "out-of-plumb", which is not to be confused with construction plumbness tolerances), tapered (so that an inside or outside surface is not plumb), curved in vertical section (for example, as in a cooling tower structure), or a combination of these geometries. Example of such vertical or near-vertical structures include, without limitation, closed-form shell structures such as silos, stacking tubes, towers, cooling towers, chimneys, hollow columns, tanks, tank stems, bins, ponds, shear wall chambers, and retaining wall enclosures. Such structures can also be open-form structures, such as retaining walls, sound walls, shear walls, bearing walls, bunkers, curtain walls, columns, and column bents. Such structures further include a combination of closed-form and open-form structures, known as combination-form structures. Closed-form structures are those structures where the walls of the structure in a plan view can be traced an infinite distance (i.e., without reaching any dead ends). That is, there are no "gaps" in the walls of the structure. Closed-form structures can be made up of a plurality of chambers, a chamber being defined as a portion of the closed-form which by itself passes the closed-form trace test. Open-form structures are those structures where the walls of the structure in a plan view cannot be traced an infinite distance without reaching a dead-end or open-ended wall, no matter which way the trace progresses or where the trace is initiated. A combination-form structure has one or more chambers and one or more open-ended walls associated therewith (i.e., it is comprised of both a closed-form structure component and an open-form structure component). The present invention is useful for constructing relatively short concrete structures. By "relatively short" I mean the final height of the structure is not significantly proportionally larger than the width, length, breadth or diameter of the structure. Examples of relatively short closed-form and open-form reinforced concrete structures include thickener tanks, mixing tanks, ponds, shallow bins, bunkers, retaining wall enclosures, retaining walls, tunnel walls, columns, column bents, bearing walls, sound walls, and curtain walls. The present invention is also particularly useful for constructing relatively tall concrete structures. B y "relatively tall" I mean the final height of the structure is significantly proportionally larger than the width, length, breadth or diameter of the structure. Examples of relatively tall closed-form structures include silos, stacking tubes, towers, cooling towers, tower and tank stems, tanks, chimneys, and bins. Examples of relatively tall open-form and combination-form structures include corrugated retaining walls, silo-open storage bunkers, stacking walls, corrugated sound walls, arch dams, and high-rise shear walls.

Prior art methods of constructing relatively short concrete structures, such as shear walls, typically employ conventional forming techniques. For relatively short structures, such as straight walls, conventional reinforced plywood forms are frequently used. For forming relatively short curved walls, prior art construction methods include those described in U.S. Pat. No. 4,915,345 (Lehmann) and U.S. Pat. No. 5,125,617 (Miller et. al.). Prior art methods for constructing relatively tall closed-form concrete structures typically employ one of two approaches: (1) the jump-form method of construction, as generally described in U.S. Pat. No. 3,871,612 to Weaver; or (2) the slip form method of construction, such as generally described in U.S. Pat. No. 5,241,797. However, relatively tall open-form and combination-form structures are not addressed by slip-forming or jump-forming, and are not economical with conventional forming methods except as they are done in a "relatively short" format. This means that these types of relatively tall, open-form structures are not currently produced in a systematic or machine-like fashion, as are relatively tall closed-form structures.

Prior art methods of constructing vertical concrete structures also employ the method of segmental casting. Segmental casting or construction is generally defined as forming sections or segments of a larger reinforced concrete structure (e.g. a closed-form structure such as a silo, or an open-form structure such as a tall retaining wall) in vertical or near vertical segments which are cast with discrete horizontal or near-horizontal levels or cold joints (as in jump-forming) or in a continuous fashion (as in slip-forming). A complete structure is constructed by casting multiple, vertical or near-vertical segments either immediately adjacent to each other, or with gaps between them which are later filled with filler or closure segments which are cast in the same or similar manner. A structure cast in vertical segments can be identified as having vertical or near-vertical construction joints running the full height of the structure.

The distinction of "relatively tall" and "relatively short" structures is best defined by the construction methods typically employed to construct these structures, and the inherent technical and economic reasons for using such methods. Tall structures tend to be closed-form structures for storing bulk materials, and so that they will be of sufficient rigidity and strength to contain the stored materials and, even during construction, they will be of sufficient rigidity and strength against horizontal loadings such as wind and seismic forces. Tall, closed-form structures also tend to be prismatic, and are often symmetrical about the vertical axis. Accordingly, there are economic efficiencies to be gained in taking a less labor intensive, more system-like or machine-like approach to forming the closed-shape. As a result, the prior art method typically employed is jump-forming or slip-forming, which lend themselves more readily to discrete or continuous casting of tall structures. Short structures typically do not have the geometric efficiencies of tall structures and construction methods thereof typically employ conventional forming methods rather than more specialized methods such as jump-forming or slip-forming. In conventional forming methods the concrete forms are often close enough to the ground or floor level to allow for an entirely different means of external stability than is afforded when the forms are a great distance from the ground, and therefore allow for a less costly platform, work deck, or floor access to the work. A shear wall chamber in a building, for example, though it may be relatively tall compared to the building itself, is normally constructed between floors, using each floor as a work platform, and therefore it is not considered "relatively tall". Such a wall would, however, be considered as "relatively tall" if it is free-standing for at least several floor heights or more during construction. In summary, relatively short structures are those which are typically produced using conventional forms because they are only a few stories tall and can therefore be economically accessed and manipulated from the ground or floor level, and relatively tall structures are those which are more than a few stories tall and require more of a machine-type approach to be most economically accessed and manipulated to accomplish the casting of reinforced concrete.

In the prior art jump-form method of construction, a cylindrical shell (closed-form) structure is produced using a series of inside and outside steel forms continuously attached together within either of the two concentric rings, but not between the rings. The rings are stacked one upon another and poured with concrete one level (levels typically vary 2' to 6' high) at a time until such time as they are 2 or more levels high. Then the bottom-most set of inside and outside forms are "jumped" or stacked on top of the top-most set of forms. This "jump" process is repeated until the structure height is achieved. Such an approach realizes a structure comprised of vertically-stacked, monolithic closed-form rings (typically 2' to 6' in height and 8" to 2' in thickness) with "cold" construction joints between rings. Important elements of the prior art jump-form method of construction are as follows: (1) The forces of the fluid concrete are resolved in the hoop rigidity of the circular ring of forms, and therefore the diameter of the structure is limited to a finite diameter, the fluid concrete forces of which are not greater than the tensile capacity of the forms and form fasteners; (2) the forms are moved upward separately of the work deck by mechanically "jumping" them with jib cranes to the next level, and the work deck moves upward with the use of climber winches which thrust off of the inside forms or off of supports which support from the ground and/or intermittently along the height of the inside surface of the structure; (3) plumbness of the structure is maintained by references with a transit or plumbob and repositioning of the form heights about the vertical axis of the structure in subsequent "jumps"; (4) the work deck is only on the inside of the concrete cylinder being constructed; (5) in order to raise the inside forms, the work decking must be removed or tilted out of the way frequently, or gaps must be left between the deck and the wall face; (6) the jump-form system must be thoroughly assembled and configured into a cylindrical shape from a large number of small, modular pieces; and (7) the forms are released from the concrete surface by prying them off manually, typically one-at-a-time.

In the slip-form method of construction, a closed-form shell structure is effected by moving a single level of concentric, typically plywood forms (commonly 4' tall) continuously upward while installing rebar and pouring concrete until the structure height is achieved. Such an approach realizes a structure that is essentially monolithic throughout to the extent that the constructor keeps the operation continuous and there are no cold joints. Important particulars of the slip-form method of construction are the following: (1) unlike the jump-form method, the inside and outside forms are tied together with yokes (spaced approximately every 2' to 8', depending on the structure requirements for the form, around the entire perimeter of the structure section) and therefore the forces of the fluid concrete are resolved in the moment rigidity of the form-yoke combination; (2) the forms hold themselves and the accompanying work deck to the structure via a combination of pipes (which become buried in the concrete of the structure) and jacks that tie into the form-yoke system; (3) the forms and work deck(s) move upward together via thrust of the jacks on the pipes; (4) plumbness of the structure is maintained by references with a transit or plumbob and the form-deck system is re-oriented about the vertical axis of the structure by differential movement of the many jacks that support the forms and deck around the perimeter of the structures. There is an inherent flexibility of the pipes which, in conjunction with any imbalance of the deck load, often causes the deck and forms to "spin" or "sway". This must be controlled by some means of bracing the pipes against the structure and/or rebar in the structure. There is currently no standard practice for controlling sway; (5) the main work deck is primarily on the inside of the shell or walls of the closed-form structure being constructed, with a swing scaffold hanging from the outside forms to allow finishing of the concrete surface; (6) the inside work deck spans across the diameter or span of the structure and is often comprised of the roof beams and roof decking; (7) the work deck is constructed such that there is little or no gaps between the deck and the forms; (8) the slip-form is typically not modular or re-usable and must be thoroughly constructed and configured into the closed-form shape from a large number of raw material pieces such as steel beams, lumber, and plywood; and (9) the forms are released from the concrete formed surface automatically and continuously since slip-forming is a continuous process.

In the conventional forming method for relatively "short" closed-form and open-form structures, a structure is produced by attaching the typically rectangular forms together into panels to form a partial or total wall or structure height. These panels are then backed by whalers to stiffen them between tie points, are tied through the wall by snap ties or through-bolts, and are usually braced or "kicked" to the ground or to a nearby floor level or structure with strut supports to plumb and stabilize the forms. Curvilinear structures are produced with either increments of straight forms or with special curvable forms. These specialized forms are a modified version of the straight form, with allowance for the form stiffeners and/or whaler system to be set manually to a certain radius. In either the straight wall or curved wall conventional form systems the work platform typically has no particular function other than as access to the work at the top of the forms. Important particulars of the conventional forming method of construction are as follows: (1) Unlike the jump-form method or the slip form method, the inside and outside forms are tied together with special ties that remain in the concrete, or through-bolts which are extracted after casting the concrete, and therefore the forces of the fluid concrete are resolved in the tensile rigidity of the tie or through-bolt; (2) the forms and work plafform(s) are moved upward manually and separately after removal of the ties or through-bolts, and typically a level of forms is left at the top of a pour to rest the next set of forms upon; (3) plumbness of the structure is maintained by references with a level, transit or plumbob, and the form-plafform system is re-oriented about the vertical axis of the structure by adjusting the kicker struts; (4) the work deck is attached to the forms and therefore spans along the perimeter (as compared to jump-forms and slip-forms which span across the formed opening); (5) the work platform being attached to the forms has a small gap between them and the form; (6) the conventional form system must be thoroughly assembled and configured from a large number of small, modular pieces to form a structure; and (7) the forms a re typically released manually from the formed surface by prying action.

There are several shortcomings with the prior art. Specifically: (1) Vertical segmental construction is not addressed by jump-form or slip-form methods of construction; (2) although segmental construction is addressed by conventional means, only relatively short structures can be economically effected by conventional means (i.e., conventional forming methods of construction are not economically adaptable for construction of tall, closed-form or open-form structures); (3) although accurate geometric measurement is possible with all methods of construction given modern surveying equipment, accurate geometric control is not inherently achievable for relatively tall and/or large footprint structures constructed with the current jump-form or slip-form methods of construction; (4) modern jump-forming and slip-forming techniques are very labor intensive; (5) none of the three concrete forming methods described above (jump-forming, slip-forming, and conventional forming) are readily adaptable to both discrete and continuous forming; (6) the methods by which jump-forms, slip-forms, and conventional forms are borne by the evolving structure is cumbersome to productivity; (7) in all three forming methods there are significant limitations on geometries due to the method of resolution of the hydrostatic force of the concrete between the inside and outside forms; and (8) jump-forming inherently does not allow for a work deck on the outer ring of forms.

The reason why conventional forms are not readily adaptable for construction of tall, open-form structures is inherent in the method: the process of loosening the forms from the wall-ties or through-bolts, lifting the forms vertically to the next level, and attaching the wall-ties or installing the through-bolts is a very cumbersome, labor intensive operation. It also requires the continuous use of very large cranes for great heights.

None of the prior art methods of constructing concrete structures address both discrete and continuous modes of operation in the vertical or near vertical direction. Jump-forms are not designed, nor are they readily adaptable for, slip (continuous) forming. Slip-forms are not designed, nor are they readily adaptable for, discrete forming. Although discrete forming with slip-forms may be an inadvertent result of stopping the slip form operation and letting the concrete set-up, it is not an intended function, nor is it a simple matter to get a slip-form moving again when the concrete sticks solidly to the forms. Conventional form systems are either designed to be used for horizontal slip-forming (e.g. a tunnel slip-form) or are designed for static (discrete) casting. They cannot be readily transitioned for use in a bi-model fashion.

Slip forms, though relatively failsafe in the sense that the support pipes are continuously buried in the wall, are inherently cumbersome for placing rebar and concrete because the pipe and yoke system repeats itself so frequently around the perimeter. Because of this, structures with dense rebar and/or large perimeters are impractical with slip-forming. The through-bolt or tie system which holds conventional forms to the concrete structure also support the work platforms. This "tie-through" method of resolving the hydrostatic forces from the concrete and attaching the forms to the concrete is cumbersome to upward progression because of the labor-intensive process of removing and re-inserting bolts or ties. In the prior art chord-form method of construction a vertical portion or vertical segment of a cylindrical structure is formed by tensioning the concentric set of jump-forms (of the type described in U.S. Pat. No. 3,871,612, being approximately 4' tall by 6' long) to buttress trusses which are positioned vertically at either end of the vertical segment in modular lengths that are a multiple of the form height. A chord deck and an outside wrap-a-round deck span between these buttress trusses, allowing access to both sides of the segment of jump forms. As with jump-forming, jib cranes are used to raise or "jump" the forms and climber winches are used to raise the chord deck that interfaces with the perimeter of the evolving wall segment. As a supplementary hoisting method to the climber winches, the inside and outside chord trusses and attached work-deck are hoisted by way of hydraulic cylinders along guides on the buttress trusses. Closure segments are effected by reconfiguring parts of the buttress trusses and bolting them to the adjacent segments.

There are a number of shortcomings with the prior-art chord-form method: (1) As with the classical jump-form method which relies on the hoop tensile capacity of the forms to resolve the hydrostatic forces from the concrete, there is a practical limitation on both the geometry and maximum diameter which can be achieved. The geometry is limited to curved walls, and the radius of the curved wall is limited to that finite value where the fluid concrete forces are not greater than the tensile capacity of the forms and form fasteners. A 60' radius curve is the practical limit for using these types of forms; (2) As with jump-forming, the chord-form method requires two or more levels of forms, and it requires that these forms be "jumped", a very labor intensive process; (3) The chord-form method requires heavy buttress trusses at both ends for the full height of the segment being constructed. The capital and mobilization costs associated with these trusses are very high and set-up times are long, especially for very tall segments; (4) Vertical alignment of the segment can only be achieved when each new buttress truss is installed, and only to the degree to which the truss can be tilted out of plumb to correct the alignment.

What is needed then is a method of, and apparatus for, constructing vertical or near-vertical concrete structures which achieves the benefits to be derived from similar prior art methods and devices, but which avoids the shortcomings and detriments individually associated therewith.

SUMMARY OF THE INVENTION

One embodiment of the present invention provides for an apparatus for forming concrete structures. The apparatus includes a first truss module and a second truss module, as well as a first concrete form and a second concrete form. The apparatus further includes a first actuator device and a second actuator device. The first actuator device is mounted on the first truss module, and the second actuator device is mounted on the second truss module. The first actuator device can move the first form translationally with respect to the first truss module, and the second actuator device can move the second form translationally with respect to the second truss module. A yoke connects the first truss module to the second truss module to place the first and second concrete forms in generally parallel, spaced-apart relationship. A climbing device attached to the yoke can engage a climb rod and move the apparatus in a generally upward direction along the climb rod.

Another embodiment of the present invention provides for a concrete forming module which has a semi-flexible concrete form, an actuator frame, a form-shaping actuator supported by the actuator frame, and an elongated form-anchoring member. The form-anchoring member has a first end connected to the form at an anchor point. The form-anchoring member is further connected to the actuator frame. The module includes a form-shaping member having a first end connected to the form, and a second end connected to the form-shaping actuator. The form-shaping actuator is configured to produce relative movement between the second end of the form-shaping member and the anchor point, to thereby urge at least a portion of the form into a curvilinear shape.

These and other aspects and embodiments of the present invention will now be described in detail with reference to the accompanying drawings, wherein:

DESCRIPTION OF THE DRAWINGS

FIG. 17A depicts the truss modules depicted in FIG. 17, but with a work deck applied over the top of the truss modules.

FIG. 17B depicts a plan view detail for a form-extending module.

DETAILED DESCRIPTION OF THE INVENTION

Figure 1:
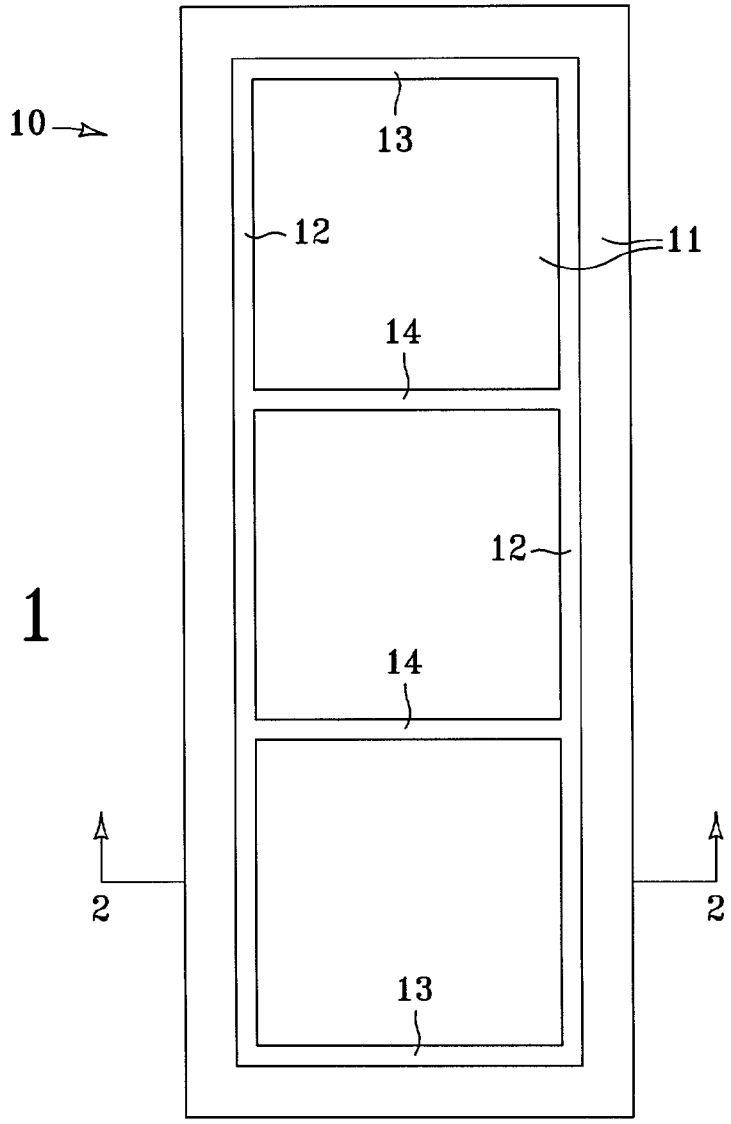
FIG. 1 is a plan view depicting a multi-chamber, closed-form concrete structure that can be constructed using methods and apparatus of the present invention.

The invention provides for methods and apparatus useful for construction of vertical and near-vertical concrete structures. The apparatus allows for such structures to be formed in either a slip-form type casting mode, a jump-form type casting mode, or a combination of these modes. The apparatus can be used to produce vertical and near-vertical concrete structures in a segmental-type casting mode, as well as in a monolithic casting mode. The apparatus of the present invention may from time-to-time be referred to herein as a "jump-slip machine" since it can be used to perform both of these prior art methods of forming concrete structures. The term "jump-slip machine" is appropriate since the apparatus can cast vertical or near vertical reinforced concrete segments, or whole structures, in either a discrete (jump) or continuous (slip) mode. The methods and apparatus of the present invention are particularly useful for forming any size of closed-form, open-form, or combination-form reinforced concrete shell structure, such as hollow columns, cooling towers, reactors, dams, chimneys, tanks, bins, ponds, bunkers, retaining walls, sound walls and curtain walls, all in vertical or near-vertical oriented segments, or monolithically.

As will be described more fully below, one embodiment of the present invention provides for a concrete forming apparatus having radially-matched pairs of automatically or semi-automatically retractable (self releasing) form modules that can be actuated automatically and/or manually into rectilinear, curvilinear, or geometric combination sub-segments with the use of translational actuators and/or adjustable length struts which bear upon and reference to supporting truss modules. The apparatus can further include a work-deck ("deck") portion which can move translationally with the forms, and preferably conform to the plan-view shape of the forms by way of an overlapping fan type work-deck plates and telescoping handrails. Very large, very complex vertical concrete structures can be formed using apparatus of the present invention when they are joined together in series, and when specialized versions of the apparatus (such as corner-forming adaptations) are used.

As stated previously, the apparatus of the present invention can cast monolithically, as well as in vertical segments. Further, the apparatus can accomplish continuous casting (slip-forming) as well as discrete casting (jump-forming). Virtually any structure geometry can be formed using the apparatus of the present invention, including but not limited to structures that are straight or curved, prismatic or tapered, and stepped or non-stepped. In addition, the apparatus of the present invention uses significantly fewer components than prior art apparatus, requires less manpower to operate, and provides improved geometric control over prior art methods of forming vertical concrete structures.

Methods and apparatus of the present invention are particularly suited to construction of medium to tall open-form structures since: (a) the forms are not tied together through the concrete, thereby making raising of the work deck and forms a relatively simple activity; (b) the bracing of the forms, which ensures that the concrete is cast accurately in 3D, is handled readily by the inherent in-plane and out-of-plane rigidity of the support truss and yokes and attitude control modules (described below); and (c) removal of the forms and work deck from the structure is easier than prior art methods.

Figure 2:
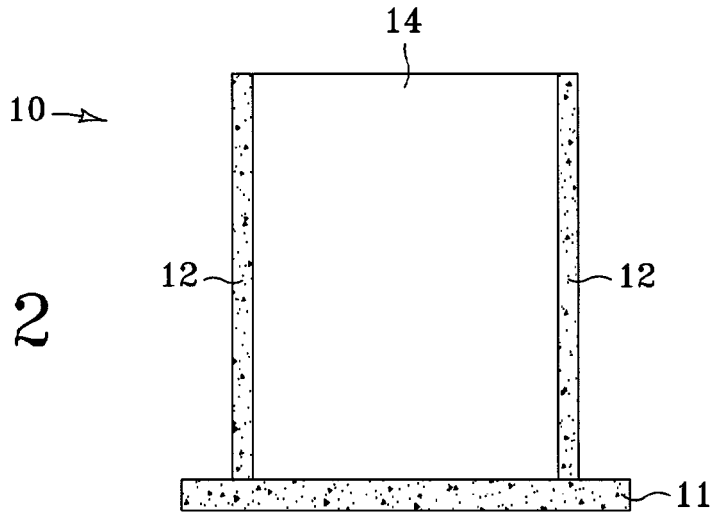
FIG. 2 is a side sectional view of the concrete structure depicted in FIG. 1.
Figure 3:
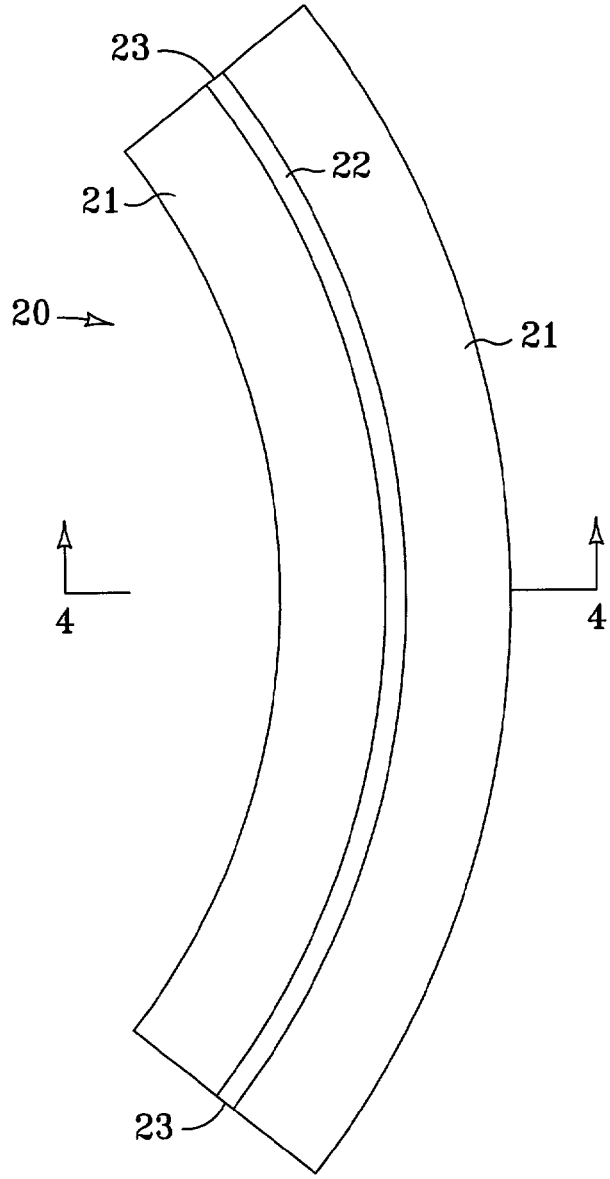
FIG. 3 is a plan view depicting an open-form concrete structure that can be constructed using methods and apparatus of the present invention.
Figure 4:
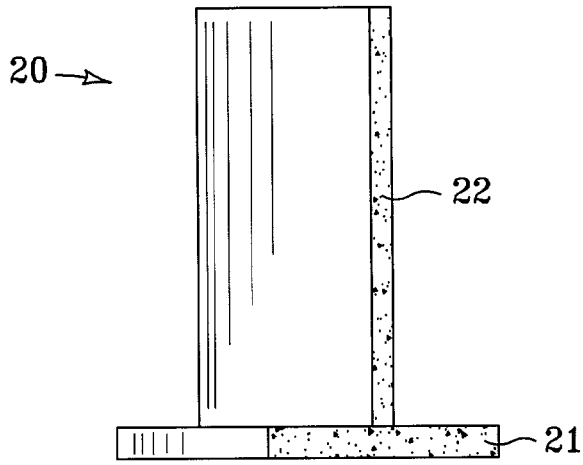
FIG. 4 is a side sectional view of the concrete structure depicted in FIG. 3.
Figure 5:
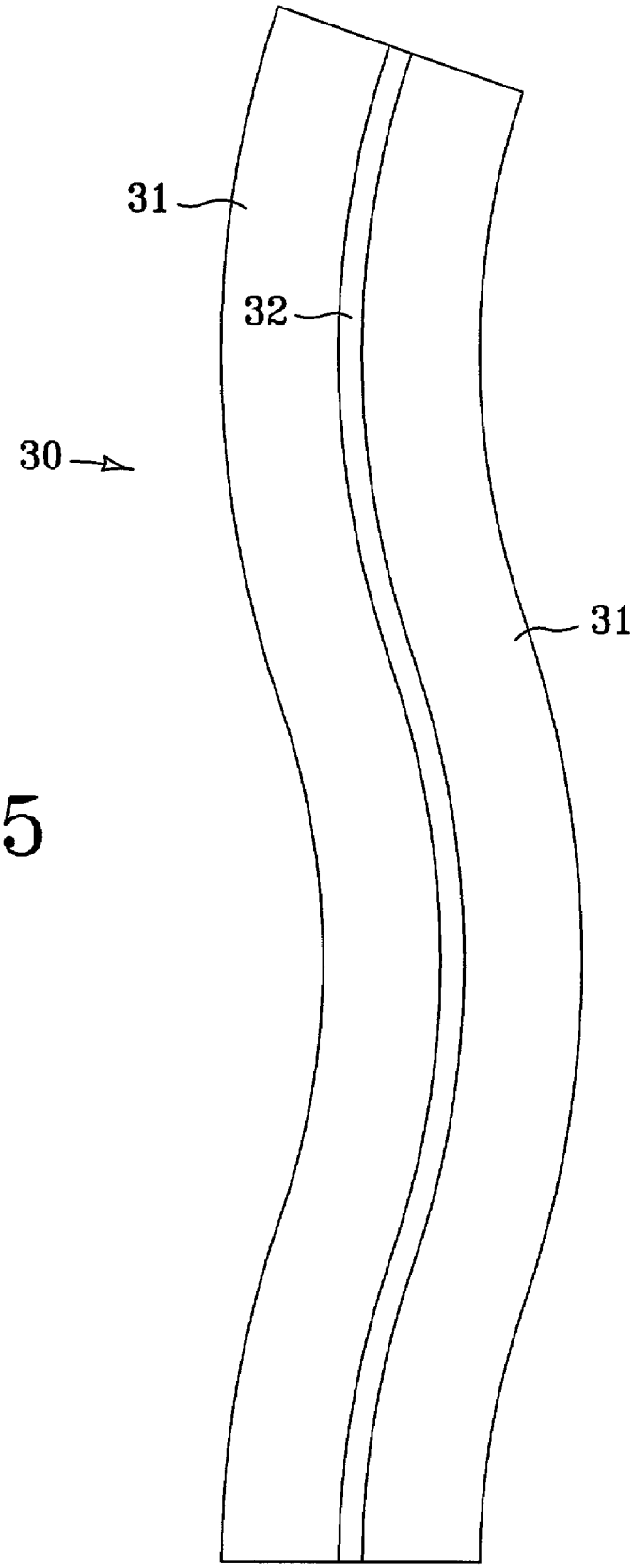
FIG. 5 is a plan view depicting another type of open-form concrete structure that can be constructed using methods and apparatus of the present invention.

Turning now to FIG. 1, a plan view of a multi-chamber, closed-form concrete structure 10 is depicted. This is one example of the type of concrete structure that can be produced using methods and apparatus of the present invention. The structure 10 is a bank of open-top parallelepipeds which typifies storage bins. The structure comprises a foundation 11 upon which are supported outer side walls 12, end walls 13, and inner divider walls 14. FIG. 2 depicts a side elevation sectional view of the structure 10 shown in FIG. 1. FIG. 3 depicts in plan view another type of vertical concrete structure that can be formed using methods and apparatus of the present invention. The structure 20 depicted in FIG. 3 comprises a radially curved wall section 22 which is supported on a foundation 21. As depicted, structure 20 is an open-form structure. However, additional similar structures 20 can be joined together at the wall ends 23 to produce a closed-form structure, such as a circular tank or tower. The wall structure 20 is depicted in a side elevation view in FIG. 4. FIG. 5 depicts a plan view of yet another wall-form structure that can be formed using the methods and apparatus of the present invention. Wall structure 30 of FIG. 5 comprises a wall segment 32 supported by a foundation 31. As can be seen, wall segment 32 is in a compound curve form. Such a wall form as wall 32 can be used, for example, as a sound wall adjacent a freeway. In addition to the curved wall structures depicted in FIGS. 3 and 5, straight wall segments can also be formed using the methods and apparatus of the present invention. Further, using the methods and apparatus of the present invention, any or all of these wall forms can be formed in duplicate, and/or in conjunction with one another, to produce complex open-form or closed-form structures.

Figure 6:
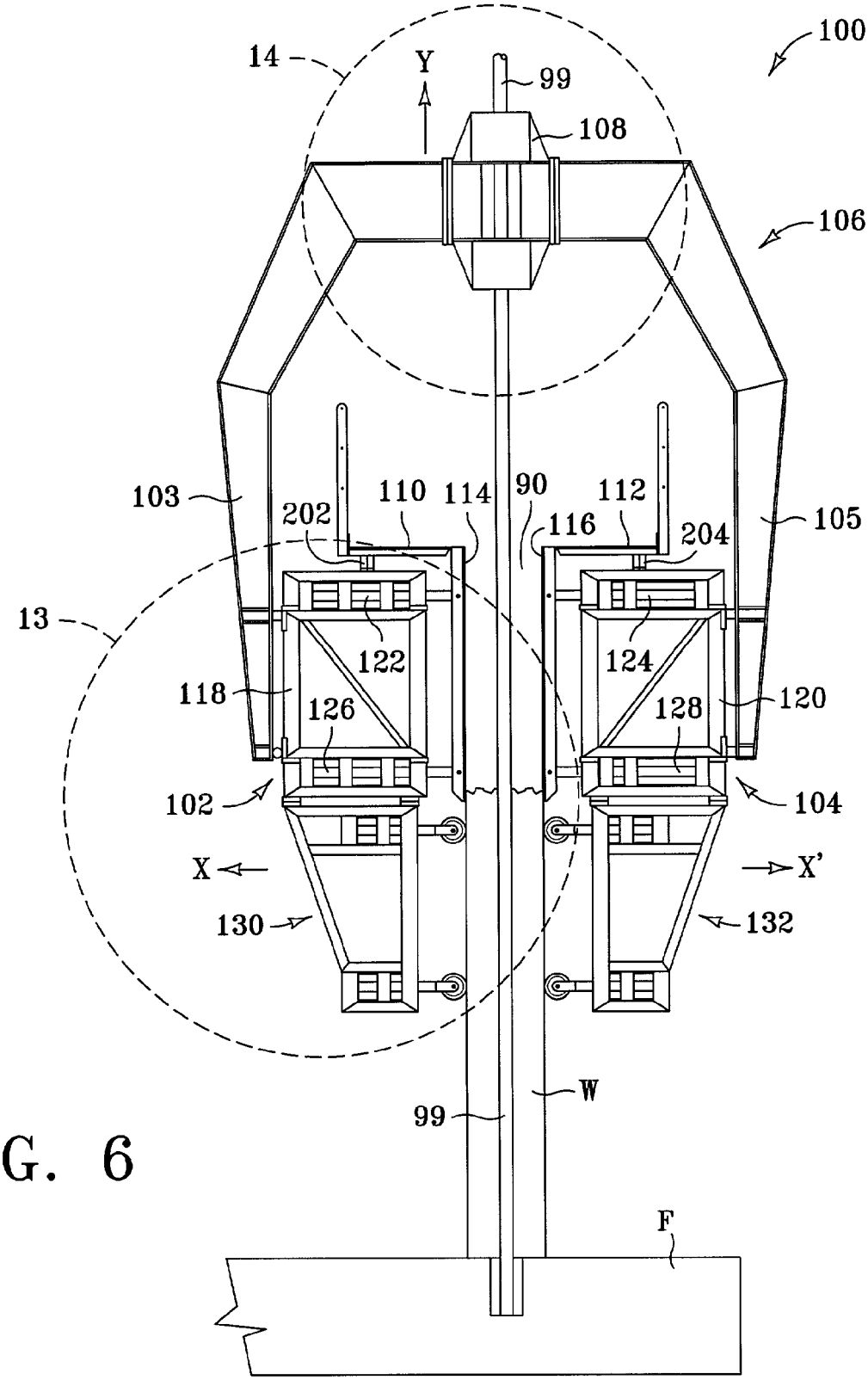
FIG. 6 is a side elevation view depicting an apparatus in accordance with an embodiment of the present invention.

Turning now to FIG. 6, one embodiment of an apparatus in accordance with the present invention is depicted in a side elevation view. The concrete forming structure 100 is depicted in the process of forming a vertical concrete structure or wall "W", which is supported on foundation "F". A climb rod or climb pipe 99 is embedded in the wall "W" and the foundation "F", and is used by the apparatus 100 to pull itself upward in direction "Y", as will be described more fully below. The apparatus 100 includes first forming assembly (also known as a "concrete forming module) 102 and second forming assembly ("concrete forming module") 104. First forming assembly 102 supports a first concrete form 114, and second forming assembly 104 supports a second concrete form 116. Concrete forms 114 and 116 are in spaced-apart, generally parallel orientation to one another, thus defining void area 90 into which liquid concrete can be poured to generate the wall "W". Preferably, forms 114 and 116 are fabricated in a semi-flexible manner to allow them to be urged into curvilinear shapes, as will be described more fully below. Forms 114 and 116 are preferably moveably supported by respective truss modules 118 and 120. Truss modules 118 and 120 are in turn attached to the respective yoke arms 103 and 105 of the yoke module 106. (Yoke arms 103 and 105 generally form a yoke, which is unnumbered in the figure.) Yoke module 106 includes the climbing module 108 ("climbing device"), which can engage the climb rod 99, allowing the whole apparatus 100 to be pulled upward in direction "Y". A work deck (or "deck") comprises first deck portion 110 and second deck portion 112, which are attached to respective forms 114 and 116, and supported by respective truss modules 118 and 120 in a moveable fashion to allow the deck portions 110 and 112 to be able to move translationally (i.e., towards or away from the wall "W") with respect to the truss modules 118 and 120.

As a general description of the operation of the apparatus 100 of FIG. 6, the truss modules 118 and 120 allow the respective forms 114 and 116 to be placed into proper position for the forming of concrete to form the wall "W". Actuator mechanisms 122 and 126 (associated with form 114) and actuator mechanisms 124 and 128 (associated with form 116) allow the individual forms 114, 116 to be moved in directions X and X', relative to the wall "W" and the truss modules 118 and 120. In this way the forms can be retracted from the wall and the apparatus 100 can then be moved upward (In direction "Y"), as in a jump-forming operation. Likewise, the forms 114 and 116 can be maintained in the concrete forming position while the apparatus 100 is moved upward, as in a slip-forming operation. The manner in which the apparatus 100 is operated (slip-form or jump-form) will depend on a number of variables, such as the type of structure being formed and the desired surface finish of the final structure. Further, forms 114 and 116 are preferably made from a semi-flexible material, such as heavy gauge sheet steel, to allow t hem to be deformed from a flat shape into a curved shape, as will be shown and described further below. The form 114 and 116 are preferably made from steel, the thickness of which will depend on the anticipated hydrostatic force of wet concrete contained between the walls, as well as the shape of the structure to be formed. For structures with a relatively small radius of curvature in the plan view, thinner steel will be used for the forms 114,116 to allow the forms to be urged into the proper shape. The forms 114, 116 can be further strengthened against hydrostatic forces by the use of vertically-oriented form stiffening members placed on the outside of the forms (i.e., the side opposite the side which contacts the concrete in the void area 90).

The form assemblies 102 and 104 can further include the respective first and second attitude control modules 130 and 132, which are more fully described below. In addition to providing attitude control (i.e., to "steer" the apparatus 100 in direction X or X'), the attitude control modules 130, 132 also perform the function of providing a force-reacting member to generate reaction forces against the wall "W" resulting from the forces exerted on the forms 114, 116 by the actuator mechanisms 122, 124, 126 and 128. Accordingly, the first and second attitude control modules 130 and 132 may also be properly known as respective "first and second reaction force members".

Figure 7:
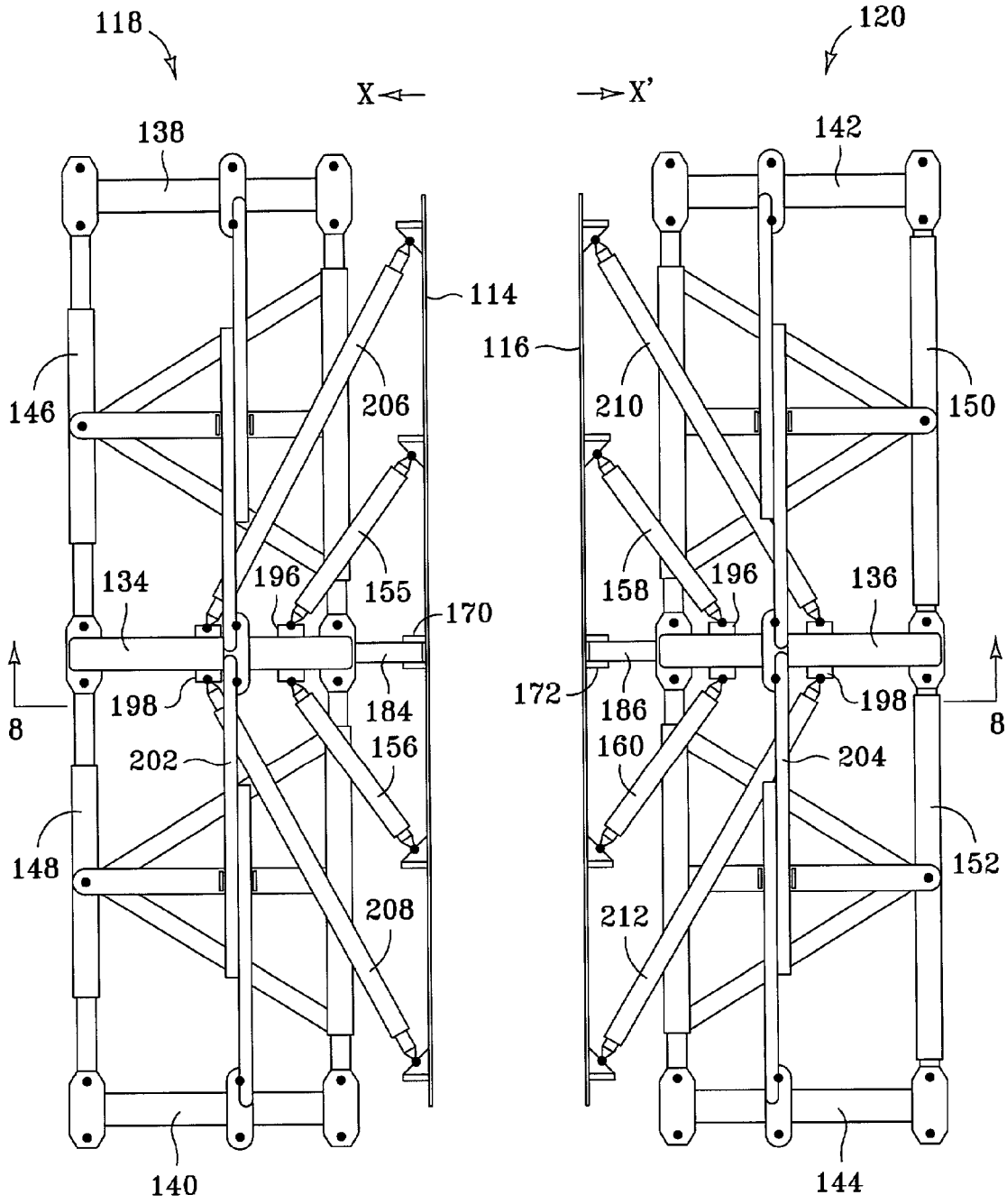
FIG. 7 is a plan view depicting truss modules used in the apparatus depicted in FIG. 6.

Turning now to FIG. 7, the truss modules 118 and 120 of the apparatus 100 of FIG. 6 are depicted in plan view. Truss module 118 is comprised of first and second end frames 138 and 140, and actuator frame 134, which is preferably centered between the end frames. End frame 138 and actuator frame 134 are spaced apart, and connected, by first space frame 146, while end frame 140 and actuator frame 134 are spaced apart, and connected, by second space frame 148. Space frames 146 and 148 will be described in more detail below. The two space frames in each truss module 118, 120 generally form an articulable space frame assembly, so that the apparatus 100 includes first and second articulable space frames. Truss module 118 supports work deck 110 (FIG. 6) by work deck support system 202, described more fully below. A series of adjustable struts 155, 156, 206, 208 are connected at a first end to form 114, and at a second end to actuators (described below) which are supported by actuator frame 134. As will be described more fully below, struts 155, 156, 206, 208 allow form 114 to be moved translationally in directions X and X', and also allow the form 114 to be deformed from the flat shape depicted in FIG. 7.

Truss module 120 of FIG. 7 is constructed similarly to truss module 118. That is, truss module 120 is comprised of first and second end frames 142 and 144, and actuator frame 136, which is preferably centered between the end frames. End frame 142 and actuator frame 136 are spaced apart, and connected, by space frame 150, while end frame 144 and actuator frame 136 are spaced apart, and connected, by space frame 152. Truss module 120 supports work deck 112 (FIG. 6) by work deck support system 204. A series of adjustable struts 158, 160, 210, 212 are connected at a first end to form 116, and at a second end to actuators supported by actuator frame 136. Struts 158, 160, 210, 212 allow form 116 to be moved translationally in directions X and X', and also allow the form 116 to be deformed from the flat shape depicted in FIG. 7. The struts 155, 156, 206, 208, 158, 160, 210 and 212 can either be passive, in that they merely track movement of the strut actuators 196, 198 (described below), or they can be active, in which case they can be adjusted to a desired length by mechanical means (such as by internal screw threads, or hydraulic pressure) and thereby be used to adjust the shape of the forms 114, 116.

The system of struts (155, 156, 206, 208, and 158, 160, 210, 212) in each truss module (118, 120) can be known as respective first and second strut modules. Preferably each form 114 and 116 is provided with at least two adjustable struts, and preferably four adjustable struts. In the embodiment described below, each form 114 and 116 is provided with eight adjustable struts arranged in a 4×2 arrangement (i.e., four struts oriented in a first horizontal plane, and four more struts arranged in a second horizontal plane which is parallel to the first horizontal plane).

Figure 8:
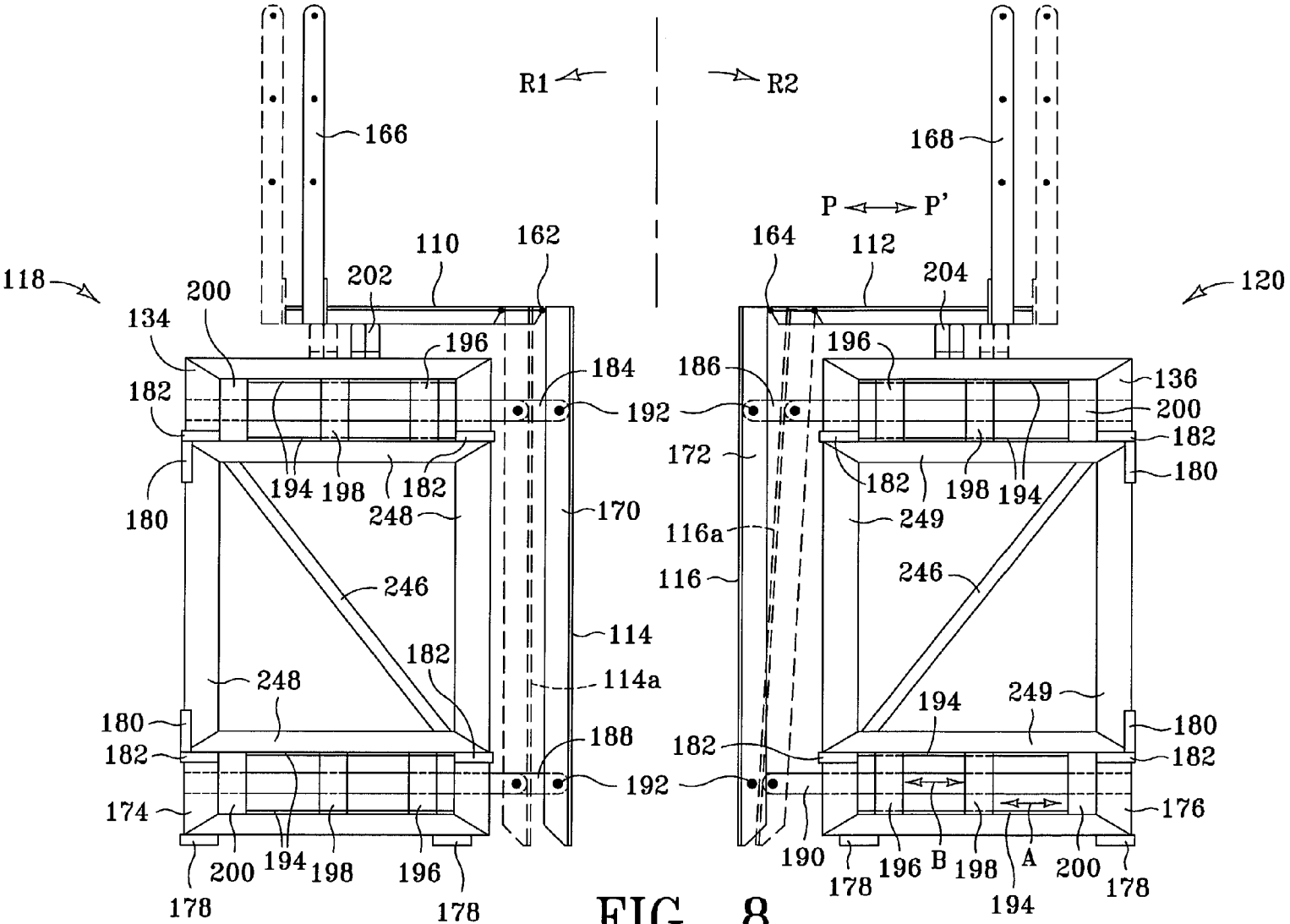
FIG. 8 is a side elevation sectional view depicting truss modules used in the apparatus depicted in FIG. 6.

Turning now to FIG. 8, a side elevation sectional view of the truss modules 118 and 120 of FIGS. 6 and 7 is depicted. In the view depicted in FIG. 8 the section line has been taken adjacent each of the actuator frames 134 and 136. Further, the struts (155, 156, 206, 208, 158, 160, 210, and 212) depicted in FIG. 7 have been removed in FIG. 8 for clarity. Each truss module 118 and 120 in FIG. 8 is provided with yoke brackets 180 to allow the yoke (106, FIG. 6) to be attached to the truss modules. Each truss module 118 and 120 is further provided with attitude module brackets 178 to allow the attitude modules 130, 132 of FIG. 6 to be attached to the truss modules.

Truss module 118 (FIG. 8) includes upper actuator frame 134, as well as lower actuator frame 174; truss module 120 includes upper actuator frame 136, as well as lower actuator frame 176. Lower actuator frames 174 and 176 are held in spaced-apart relationship from respective upper actuator frames 134 and 136 by respective rectangular main frames 248 and 249. Adjacent each actuator frame 134, 136, 174, 176 are space frame brackets 182, which allow the space frames (146, 148, 150, 152, FIG. 7) to be attached to the actuator frames (e.g., space frame 148 of FIG. 7 is attached to actuator frames 134 and 174, and space frame 152 is attached to actuator frames 136 and 176). Each actuator frame 134, 174, 136 and 176 supports actuator devices or mechanisms ("actuators"), which will be described more fully below. The use of two actuator frames for each truss module provides improved control over positioning of the forms 114 and 116, and allows additional geometric control and shaping of the final form of the concrete structure to be produced.

Forms 114 and 116 are attached to respective actuator brackets 170 and 172, which are in turn attached to first and second upper actuator shafts (actuator members) 184 and 186, and first and second lower actuator shafts 188 and 190, by hinged connectors (e.g., pins, ball joints, or any such pivotal connector) 192, allowing movement of the actuator brackets 170, 172 with respect to shafts 184, 186, 188 and 190 (FIG. 8). Actuator brackets 170, 172 serve to distribute the force exerted by the actuator shafts 184, 186, 188 and 190 over the face of the forms 114 and 116, and also serve to stiffen the forms against the hydrostatic forces of wet concrete contained between the forms. Decks plates 110 and 112 are attached to respective actuator brackets 170 and 172 by respective hinges 162 and 164, allowing rotational movement (clockwise or counterclockwise, as viewed in FIG. 8) of the deck plates 110 and 112 with respect to forms 114 and 116. This allows the forms 114 and 116 to be "tilted" (as in 116*a*), while leaving the decks 10, 112 level with the ground. Decks 110 and 112 are also provided with respective handrails 166 and 168. Deck 110 is supported on truss module 118 by deck support system 202, and deck 112 is supported on truss module 120 by deck support system 204. The deck support systems 202, 204 will be described more fully below. Preferably, lower pivotal connection 192 is a connection (such as a slotted connection) which allows slight vertical movement of the form (114 or 116) with respect to the upper pivotal connection (also 192), to allow the form (114, 116) to "tilt" (as in 116*a*) without causing a binding of an actuator member (184, 186, 188, 190) in the associated actuator frame (134, 136, 174, 176, respectively). This feature will account for the effective "shortening" in the effective height of a form face as it is tilted relative to the other form face.

Figure 9:
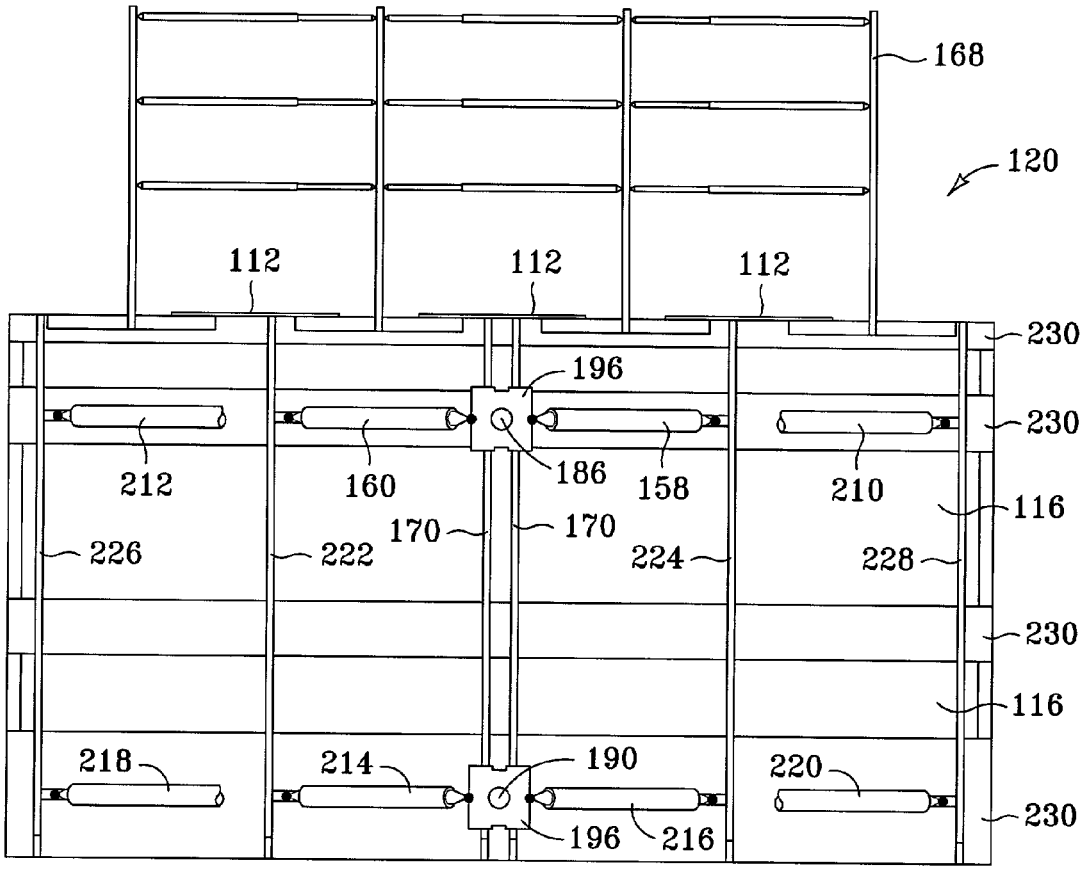
FIG. 9 is a rear view depicting a form module and a strut module used in the apparatus depicted in FIG. 6.

Actuator shafts 184, 186, 188 and 190 are preferably smooth at the area where they enter bushed bores (not numbered) in the actuator frames 134,136, 174 and 176 proximate the forms 114 and 116. Thereafter, the shafts 184, 186, 188 and 190 are preferably threaded so that they can be engaged by screw-thread actuators 196, 198 and 200. Although hydraulic actuators can be used for actuators 196, 198 and 200, screw thread actuators are preferable since they provide positive engagement of the shafts 184, 186, 188 and 190, even in the event of loss of power. The screw-thread actuators 196, 198, 200 can be actuated by electric motor, hydraulic force, or manually. Each actuator frame 134, 136, 174 and 176 comprises first and second strut actuators (actuator devices) 196 and 198 which are preferably moveably mounted in actuator frames 134, 136, 174 and 176, and the actuators 196, 198 are preferably configured to move along guides 194 within each actuator frame. Actuators 196 and 198 are preferably screw thread actuators (such as screw jacks), and engage the threads of shafts 184, 186, 188 and 190. Each strut actuator 196, 198 is preferably connected to two struts. This can be seen by viewing FIG. 8 in conjunction with FIG. 9. FIG. 9 is a rear elevation sectional view of truss module 120 of FIG. 8 with the section being taken immediately behind strut actuators 196, and shows the struts associated with module 120. Specifically, struts 160 and 158 are connected to upper strut actuator 196 in upper actuator frame 136, struts 212 and 210 are connected to upper strut actuator 198 (not seen in FIG. 9) in upper actuator frame 136, struts 214 and 216 are connected to lower strut actuator 196 in lower actuator frame 176, and struts 218 and 220 are connected to lower strut actuator 198 (not seen in FIG. 9) in lower actuator frame 176. The system of struts (158, 160, 210, 212, 214, 216, 218 and 220 of FIG. 9) can alternately be termed a "strut module" or a form-shaping module, the latter comprising form-shaping members (e.g., any or all of the indicated struts). The actuator frames are not specifically shown, and are not numbered, in FIG. 9. Viewing FIG. 7 and FIG. 8 together, struts 155 and 156 are connected to upper strut actuator 196 in upper actuator frame 134, and struts 206 and 208 are connected to upper strut actuator 198 in upper actuator frame 134. Lower strut actuators 196 and 198 in lower actuator frame 174 are similarly connected to struts that are equivalent to struts 214, 216, 218 and 220 of FIG. 9. Each of the eight strut actuators 196 and 198 can be individually actuated, or they can be actuated in concert, or in any combination. When strut actuator 196 or 198 is actuated, and the respective shaft 184, 186, 188 or 190 is held in a fixed position in the actuator frame (134, 136, 174, 176), then the actuator 196 or 198 is caused to move along guides 194 within the actuator frame in a translational position relative to the shaft, as indicated by directional arrow "A" in strut frame 176 (FIG. 8). As will be more fully described below, use of the strut actuators can cause the shape of the forms 114 and 116 to be altered, thus allowing the apparatus 100 to be used for forming curved concrete segments.

Figure 17:
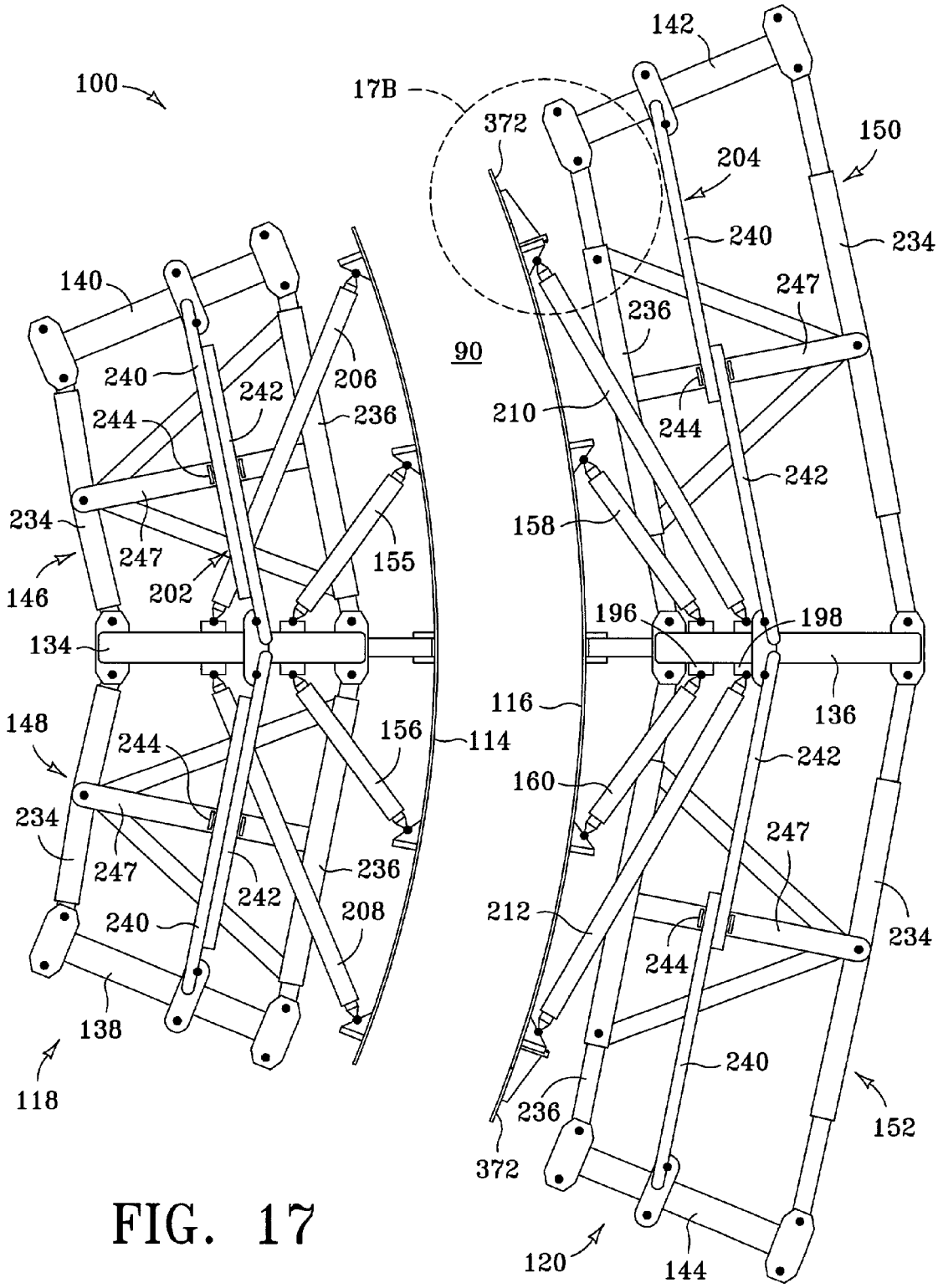
FIG. 17 is a plan view depicting how the truss modules depicted in FIG. 7 can be formed into a radial concrete forming shape.

In addition to the strut actuators 196 and 198, each actuator frame 134, 136, 174 and 176 is preferably provided with a main actuator (actuator device) 200 (FIG. 8), so that the apparatus 100 includes at least first and second main actuator devices. Main actuators 200 are also preferably screw-jack type actuators and engage screw threads on shafts 184, 186, 188 and 190. When an actuator 200 is actuated, the associated shaft (184, 186, 188 or 190) moves translationally relative to the associated actuator frame (134, 136, 174 or 176), as indicated by arrow "B" in actuator frame 176. When this occurs, the strut actuators (196 and 198) move together with the shaft within actuator frame, causing the form (114 and/or 116) to move in direction "B". In this way a form 114 or 116 can be pulled away from the formed concrete structure (e.g., wall "W" of FIG. 6), or moved towards the area where the wall "W" is to be formed (defined by void 90 of FIG. 6). For example, if actuators 200 (FIG. 8) in actuator frames 134 and 174 are actuated in concert, form 114 can be moved leftward (as viewed in FIG. 8) to the position indicated by 114*a*. Further, a form (114 and/or 116) can be tilted with respect to vertical orientation by actuating only the main actuator 200 in either the upper or lower actuator frame (or by operating the upper and lower actuators 200 at differential rates). For example, if only upper main actuator 200 in actuator frame 136 is actuated (while lower main actuator 200 in frame 176 is not actuated), then the upper portion of form 116 can be tilted in a clockwise direction (as viewed in FIG. 8) to the position indicated by 116*a*. From the foregoing description, it can be seen that actuators 200 might properly be termed "form translating actuators" since they can be used primarily to move forms 114 and 116 in translational direction towards, and away from, the face of the structure "W" (FIG. 6) being formed (or to be formed). Likewise, actuators 196, 198 might properly be termed "form shaping actuators" since they are used primarily to reshape forms 114 and 116 from a flat (linear) shape to a non-linear or curvilinear shape (e.g., as depicted in FIG. 17). Moreover, the system of form shaping actuators 196, 198 (FIG. 8) and struts (158, 160, 210, 212, 214, 216, 218, 220, FIGS. 7 and 9) can be termed "first and second form shaping devices", since their primary function is to alter the shape of the forms 114, 116. Generally, the "form shaping device" comprises a form shaping actuator (196, 198) mounted on the respective truss module (118, 120), and a form shaping member (e.g., struts 210, 212, 214, 216, 218, 220) having a first end connected to the respective form (114 or 116), and a second end connected to the form shaping actuator (196, 198). The form shaping actuator (196, 198) is configured to move the second end of the form shaping member (strut) relative to the respective truss module (118, 120), thereby urging the form (114, 116) into a curvilinear shape. As mentioned above, actuators 196, 198 and 200 (as well as actuators 260 and 264, described below with respect to the attitude control module 130 of FIG. 13) are preferably screw jack type actuators, and can be actuated manually, electrically or hydraulically. Actuators 196, 198, 200, 260 and 264 can also be hydraulic actuators (e.g., hydraulically driven piston actuators or hydraulically driven gear reduction drives), electric actuators (e.g., gear reduction drives driven by electric motor), and any other type of actuator which allows a member to be repositioned with respect to a supporting frame.

Figure 10:
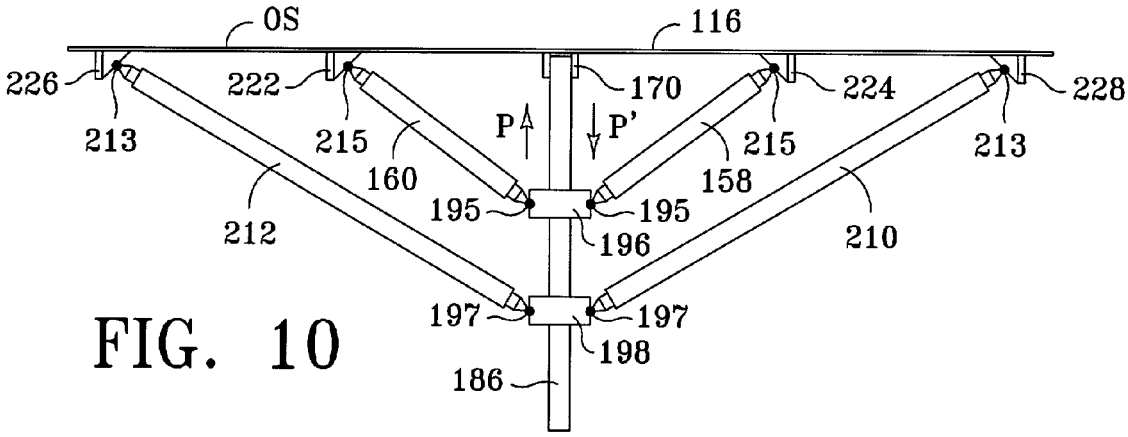
FIG. 10 is a plan view of the form module and strut module depicted in FIG. 9.

Further, main actuators 200 can be individually placed in a "locked" position so that the jack-screw within the actuator 200 is not free to rotate within the actuator 200, thus fixing the shaft (184, 186, 188 and/or 190) relative to the associated actuator frame (134, 136, 174 and/or 176). When a main actuator is placed in a "locked" position, actuation of a strut actuator 196, 198 will cause the actuator 196, 198 to move within the actuator frame (134, 136, 174, 176) along the guides 194, in the manner described above. This will result in altering the shape of the form 116 from the flat shape depicted in FIG. 7 to a curved shape, as will be describe further below. Turning to FIG. 10, the strut system associated with truss module 120 of FIGS. 7 and 8 is depicted in a plan view. Upper strut actuators 196 and 198 can be seen. It is useful to briefly view FIG. 9, which depicts a sectional view of the strut system depicted in FIG. 10, wherein the section is taken between the strut actuators 196 and 198. FIG. 9 depicts the set of upper struts 212, 160, 158 and 210 which are depicted in the plan view of FIG. 10, as well as the lower set of struts 218, 214, 216 and 220 which cannot be seen in FIG. 9. As can be seen by viewing FIGS. 9 and 10, there are sets of struts: two upper inner struts 160, 158, two upper outer struts 212, 210, two lower inner struts 214, 216, and two lower outer struts 218, 220. Each strut is preferably configured to be a variable length member. Preferably, each strut comprises an inner and an outer cylinder which are slidable with respect to one another. However, other configurations can be employed to allow the struts to be of variable length, such as a sliding rail configuration.

Turning back to FIG. 10, first ends of upper outer struts 212 and 210 are pivotally connected to strut actuator 198 by pins or ball joints 197, and second ends of upper outer struts 212 and 210 are pivotally connected to respective form frame members 226 and 228 by pins or ball joints 213. Likewise, first ends of upper inner struts 160 and 158 are pivotally connected to strut actuator 196 by pins or ball joints 195, and second ends of upper inner struts 160 and 158 are pivotally connected to respective form frame members 222 and 224 by pins or ball joints 215. A similar connection configuration is provided for lower struts 218, 214, 216 and 220, as indicated in FIG. 9. Likewise, a set of eight complementary struts for truss module 118 (FIG. 7) are pivotally connected to strut actuators 196 and 198 of truss module 118, and form 114 associated therewith. Viewing FIG. 10, the function of the strut actuators 196 and 198 in changing the shape of the form 116 can be appreciated. As shaft 186 is held in a fixed position relative to truss module 120 (FIG. 8), by virtue of the screw-jack within main actuators 200 being "locked" (as described above), form 116 can be deformed from the flat position indicated to a concave or a convex position (relative to the outside surface "OS" of form 116). For example, if strut actuator 196 is translated along shaft 186 in direction "P" while strut actuator 198 is held fixed relative to shaft 186, then the form 116 will be forced into a convex shape, whereas if strut actuator 196 is translated along shaft 186 in direction P' while strut actuator 198 is held fixed relative to shaft 186, then the form 116 will be forced into a concave shape. A similar result is achieved if strut actuator 198 is moved a long shaft 186 while strut actuator 196 is held in a fixed position. As can be appreciated, by variably positioning strut actuators 196 and 198 relative to one another, and relative to shaft 186 (and thus the associate truss module 120 of FIG. 8), a variety of curved shapes for form 116 can be achieved. While truss modules 118 and 120 are depicted as each having eight struts, a lesser or greater number of struts can be used. The number of struts used can depend on the anticipated final structure to be formed using the apparatus. For example, the shape of the concrete structure to be produced, and the anticipated hydrostatic forces from the liquid concrete, will determine whether a lesser number of struts can be used (a large number of struts will accommodate more complex geometries, and will also resist greater hydrostatic loads).

Figure 11:
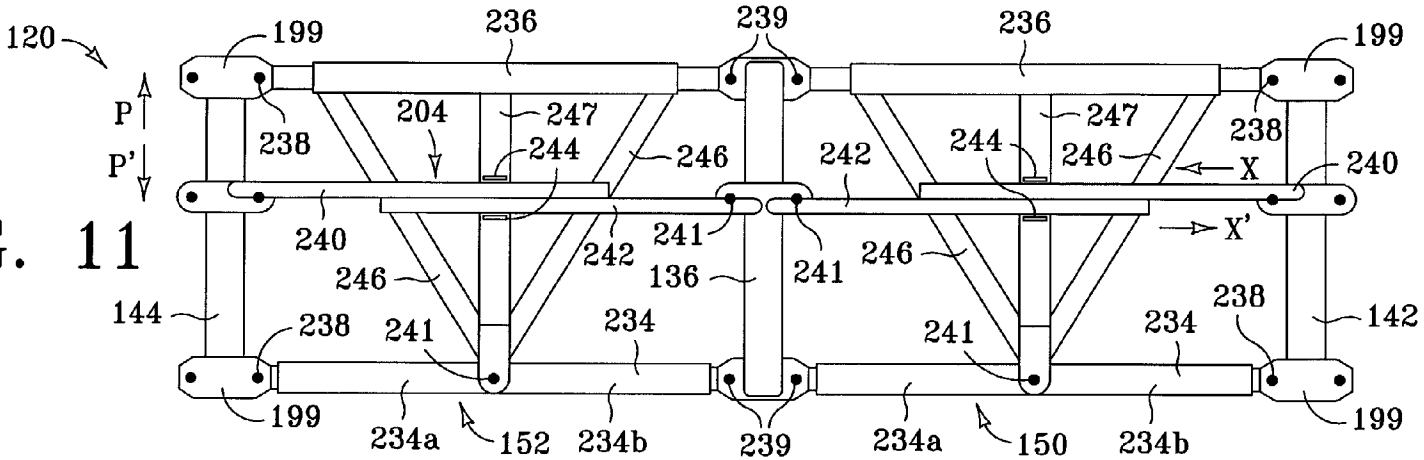
FIG. 11 is a plan view depicting frame components of a truss module depicted in FIG. 7.

Turning now to FIG. 11, a plan view of the truss module 120 of FIG. 7 is depicted in a plan view, but without the strut system depicted in FIG. 10. That is, FIG. 11 can be considered as the truss module 120 depicted in FIG. 6 minus the strut system depicted in FIG. 10. FIG. 11 allows the space frames 152 and 150 of FIG. 7 to be seen more clearly. The components of the truss module depicted in FIG. 11 include the end frames 144 and 142, the actuator frame 136, and the space frames 152 and 150 which place the respective end frames 144 and 142 in spaced-apart relationship from the actuator frame 136. End frames 144 and 142 are provided with connection brackets 199, allowing the apparatus 100 (FIG. 6) to be connected to adjacent, similar apparatus and therefore produce an integral concrete forming system (as will be described further below). Each space frame 150, 152 is pivotally connected to respective end frame 142, 144 by pins 238 at brackets 199, and each space frame 150, 152 is pivotally connected to the actuator frame 136 by pins 239. Further, each space frame 150, 152 is preferably comprised of adjustable length links 234, 236, allowing the end frames 142 and 144 to move in directions P and P' relative to the actuator frame 136 (similar to movement of the strut actuators 196 and 198 relative to the shaft 186, as indicated in FIG. 10). To achieve this movement of end frames 142 and 144 relative to actuator frame 136, each space frame 150 and 152 can comprise adjustable links. Specifically, each space frame 150, 152 can include an upper forward adjustable link 236 (proximate the associate form, in this case form 116 of FIG. 7), and an upper distal adjustable link 234 (distal from form 116). Adjustable links 234 are preferably two-part adjustable links, having first part 234*a* and second part 234*b* which are pivotally connected to space frame cross member 247 by pivot pin 241. The use of a two-part adjustable link 234 allows a greater range of adjustability of the space frames 150, 152. Each space frame 150 and 152 is also provided with a complementary lower forward adjustable link (not seen in FIG. 11) and a lower two-part distal adjustable link (not seen in FIG. 11), to thereby generate adjustable, generally "box-shaped" (i.e., three dimensional) space frames 150, 152 between the respective end frames 142, 144 and the actuator frames 136 and 176 (FIG. 8). Preferably, the adjustable links 234, 236 are configured to be secured into their adjusted positions by pins, screws, clamps or other means which prevent relative movement between the sliding members of the adjustable links. Each space frame 150, 152 can also be provided with cross brace 247 and diagonal brace members 246 to provide additional structural rigidity to the space frames 150, 152 to thereby resist the hydrostatic forces imposed on the space frames by liquid concrete placed between the forms 114 and 116 (FIG. 6), which are imparted to the space frames via the actuators 196, 198 and 200 (FIG. 8). It will be appreciated that space frames 146 and 148 of truss module 118 (FIG. 7) can be constructed similarly to space frames 150 and 152 depicted in FIG. 11. The space frames 146, 148, 150 and 152 (FIG. 7), in conjunction with the actuator frames 134, 136, and the end frames 138, 140, 142 and 144, generally provide support for the deck modules 110 and 112 (FIG. 6), as described in more detail below.

Turning briefly to FIG. 17, a plan view of truss modules 118 and 120 is depicted, showing how the space frames 146 and 148 of truss module 118 articulate about actuator frame 134 to accommodate the convex shape of form 114, while space frames 150 and 152 of truss module 120 articulate about actuator frame 136 to accommodate the concave shape of form 116. However, it will be appreciated that the form ends of forms 114 and 116 will not align if the forms 114 and 116 are of the same length, due to the greater radius of form 116 than form 114. This situation can be addressed by the use of a form extender, as depicted in FIG. 17B. FIG. 17B depicts a plan view detail of a portion of the truss module 120 of FIG. 17. Pivotally attached to the form support member 228 is a form extender 370 which includes extender form face 372. The extender form face 372 is preferably of the same curvature as the outer form 116. The use of extender forms 370 increase the arc length of the outer form 116 to match-up with the arc length of the inner form 114.

Figure 28:
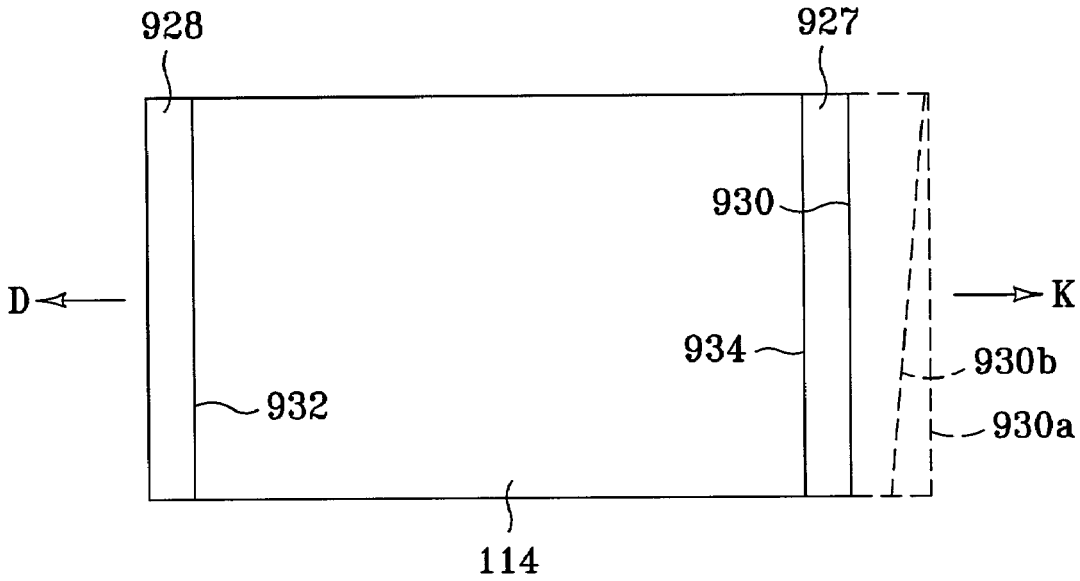
FIG. 28 depicts a side view of a concrete form having dynamic form extenders, in accordance with an embodiment of the present invention.

In addition to providing static form extenders, such as form extender 370 of FIG. 17B, the apparatus 100 can further include dynamic form extenders, as depicted in FIG. 28. FIG. 28 depicts a front view of form 114 (of FIG. 6, for example). Form 114 is provided with two dynamic form extenders 927 and 928, one form extender being provided for each side edge of the form 114. Form extender 927 is defined by extender edge 930. Form extenders 927 and 928 are moveable in directions "D" and "K" with respect to for edges 932 and 934 to thereby allow the effective width of the form 114 to be changed (either increased or decreased). In addition to moving laterally, as indicated by laterally moved form extender edge 930*a*, the form extenders 927 and 928 are preferably also rotatably positionable with respect to the form edges 932 and 934, as indicated by rotated form extender edge 930*b*. In this way complex shapes, such as concave cooling towers and domes, can be formed using the apparatus of the present invention. The form extenders 927 and 928 can be generally flat panels which are slidably mounted to the outer side (non-concrete side) of forms 114 and 116. In another configuration, the form extenders can be in the form of roller sheets which are unrolled as additional form extension is required (or conversely, "reeled-in" as form width contraction is required).

Figure 12:
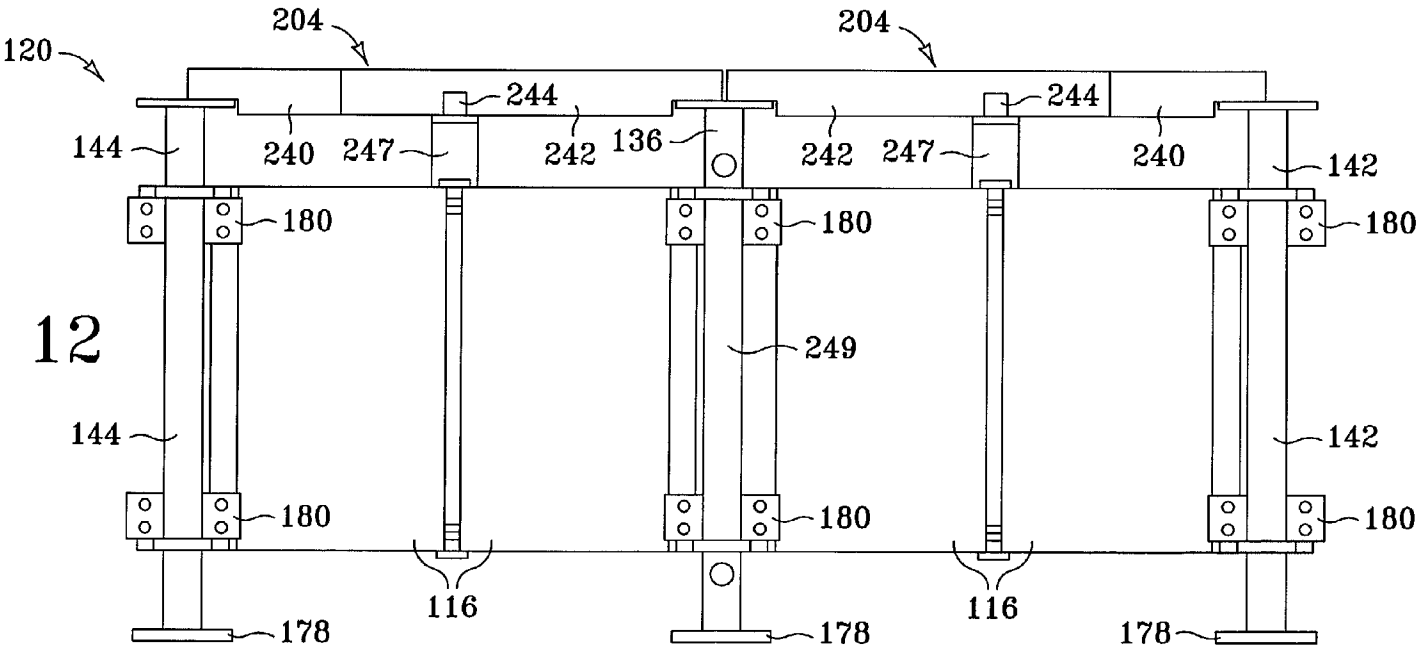
FIG. 12 is a rear view depicting end frames and an actuator frame used in a truss module depicted in FIG. 7.

The truss module structure 120 depicted in FIG. 11 supports the deck support system 204, and in the same manner the truss module structure 118 depicted in FIG. 6 supports the deck support system 202. As seen in FIG. 11, the deck support system 204 (which supports deck 112 of FIG. 6) comprises translatably associated deck support members 240 and 242 (two each) which are supported on space frames 150 and 152. Deck support members 240 are fixed to the end frames (142 or 144), and deck support members 242 are fixed to the actuator frame 136. Deck support members 240 and 242 are supported by space frame cross members 247, and are constrained by brackets 244. A similar configuration is employed for deck support system 202 (FIG. 7). Turning to FIG. 12, the truss module 120 of FIG. 11 is depicted in a rear view, but a number of the space frame components have been removed for clarity. FIG. 12 shows how the deck support members 240, 242 are supported on end frames 142 and 144, cross members 147, and actuator frame 136. Turning again to FIG. 17, it can be seen that the deck support members 240 and 242 on truss module 120 have been translated away from one another due to the expansion of the space frames 150 and 152, while the deck support members 240, 242 of the deck support system 202 of truss module 118 have been translated closer to one another.

The deck support systems 202 and 204 (FIG. 7) can be used in conjunction with an adjustable-area decking system. Turning to FIG. 17A, a plan view of the truss modules 118 and 120 depicted in FIG. 17 is shown, but the truss modules 118 and 120 are shown in FIG. 17A with adjustable-area deck plate systems 110 and 112 laid on top of the deck support systems (202 and 204, FIG. 17). Each deck plate system 110 and 112 includes a plurality of under-deck plates 294 which are preferably rigidly attached to the truss modules 118 and 120, and are placed in spaced-apart relationship from one another. The under-deck plates 294 can be perforated to allow water and concrete to fall away from the work surface. Placed over the gaps between the under-deck plates 294 are a series of over-deck plates 292 which are preferably hingedly connected to the truss modules 118 and 120. The over-deck plates 292, in combination with the under-deck plates 294, form a fan-type work deck system 110, 112, which can accommodate the expanded, or contracted, or curved, or straight shapes of the truss modules 118, 120 by relative movement of the deck plates 292 and 294 to one another. The deck plates can be fabricated from metal, such as expanded steel grating, or from a non-metallic material such as fiber reinforced plastic ("FRP"), which provides less friction between the upper-deck plates and the lower-deck plates. A non-metallic deck plate material also allows a degree of flexibility in the deck plates (within the plane of the deck plates) to accommodate changes in geometry of the associated truss module on which the work deck is supported. In addition to the fan-type deck plate systems 110 and 112, the truss modules can be provided with telescoping handrail systems 166 and 168 to allow the handrails at the outer edges of the work decks 110, 112 to also accommodate the change in size of the truss modules 118, 120 as they are placed in different configurations. As seen in FIG. 8, the work decks 110 and 112 are supported by, but not fixed to, the deck support systems (respectively, 202 and 204) so that the work decks (110, 112) are slidably disposed with respect to (i.e., can move in directions P and P' relative to) the truss modules (respectively, 118, 120), but in conjunction with the respective forms 114 and 116. That is, the work decks 110, 112 are free to translate along with respective forms 114 and 116 relative to respective truss modules 118 and 120. Hinged connection 162 (between work deck 110 and form 114) and hinged connection 164 (between work deck 112 and form 116) allow the work decks 110 and 112 to stay in a relatively fixed position with respect to the forms (respectively, 114 and 116). In this way, as the forms 114 and 116 are translated in directions P and P' (FIG. 8), the work decks 110 and 112 stay in close proximity to the associated form (114 or 116), thus eliminating a gap between the form and the work deck, as results in prior art concrete forming apparatus.

Figure 13:
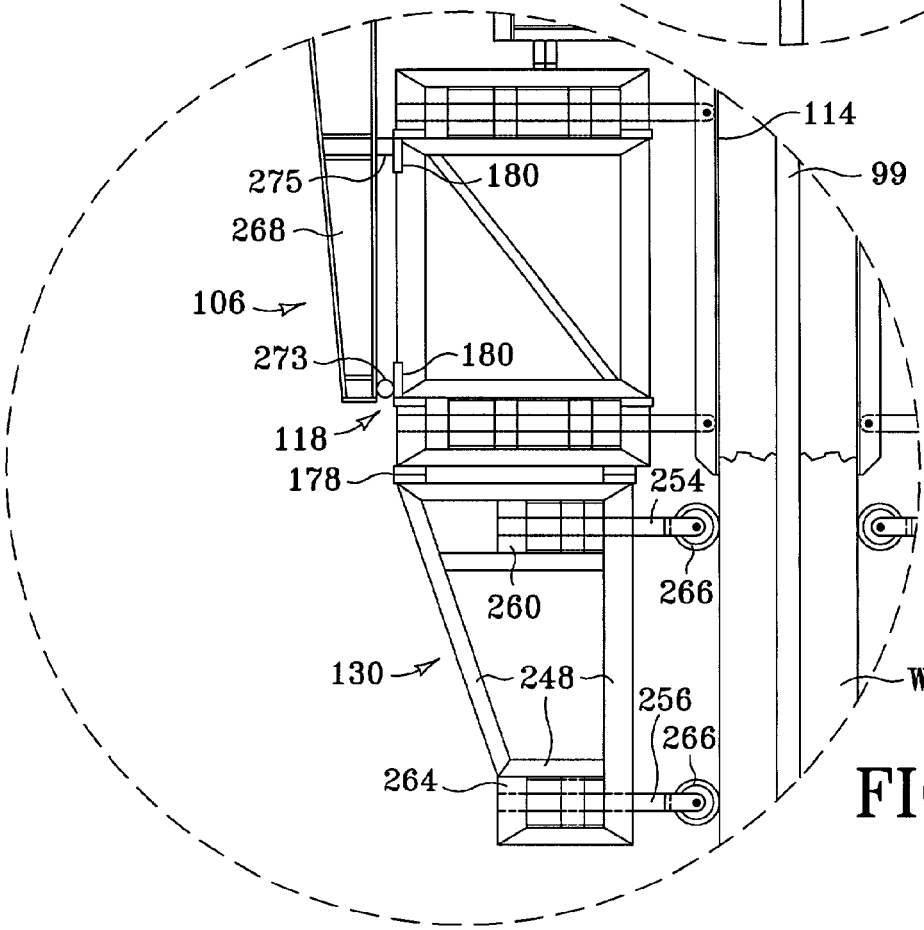
FIG. 13 is a side elevation view depicting an attitude control module that can be used in the apparatus depicted in FIG. 6.

Turning to FIG. 13, a side elevation detail of attitude control module 130 of FIG. 6 is shown. As described above, the attitude control modules 130, 132 (FIG. 6) can also be considered as reaction force members to facilitate pulling the forms 114, 116 away from the face of the concrete structure "WV" using the actuators 196 and 198. As shown in FIG. 13, attitude control module 130 is connected to truss module 118 at flange 178. Attitude control module 130 comprises main frame 248, which supports upper attitude control actuator 260 and lower attitude control actuator 264. Actuators 260 and 264 engage respective attitude positioning shafts ("attitude positioners") 254 and 256, which can be threaded shafts (similar to shaft 184, FIG. 8). When shafts 254 and 256 are threaded, then actuators 260 and 264 can be jack-screw actuators, similar to actuator 200, described above. Actuators 260 and 264 are preferably set in a fixed position in frame 248. Positioning shafts 254 and 256 are depicted as being fitted with wheels 266, which allow the attitude module 130 to track along the finished concrete wall "W". Wheels 166 can be replaced with pads to reduce the number of moving parts, but wheels 166 can cause less damage to the face of the wall "W" as the apparatus 100 moves upward. Further, a combination of wheels and pads can be used. In this instance the wheels can be spring-loaded so that they are biased towards the climb-rod 99, and therefore contact the formed wall "W" when the forms 114, 116 translate outward and away from the formed concrete wall. However, when the forms 114 and 116 are translated towards the formed wall "W", the spring-loaded wheels will be pressed into the attitude control modules 130, 132, and the pads will contact the formed wall. In another embodiment, the wheels of the attitude control modules 130, 132 can be replaced with caterpillar tractor-type treads, which allows the reaction force of each of the attitude control modules to be spread over a larger surface area of the formed wall "W". As is apparent, radial attitude control module 132 of FIG. 6 can be constructed similarly to attitude control module 130 of FIG. 13 (described above).

The attitude control modules 130 and 132 can be attached to the actuator frames 174, 176 (FIG. 8), end frames 138, 140, 142, 144, FIG. 7), and/or the space frames (146, 148, 150, 152, FIG. 7). The attitude control modules 130 and 132 can also be an integral part of the truss modules 118, 120 so that they are not "attached to" the truss modules, but are part of the truss modules. In this latter instance, the attitude control module frame 248 is but an extension of the truss module 118, and connection flanges 178 are not present.

Figure 15:
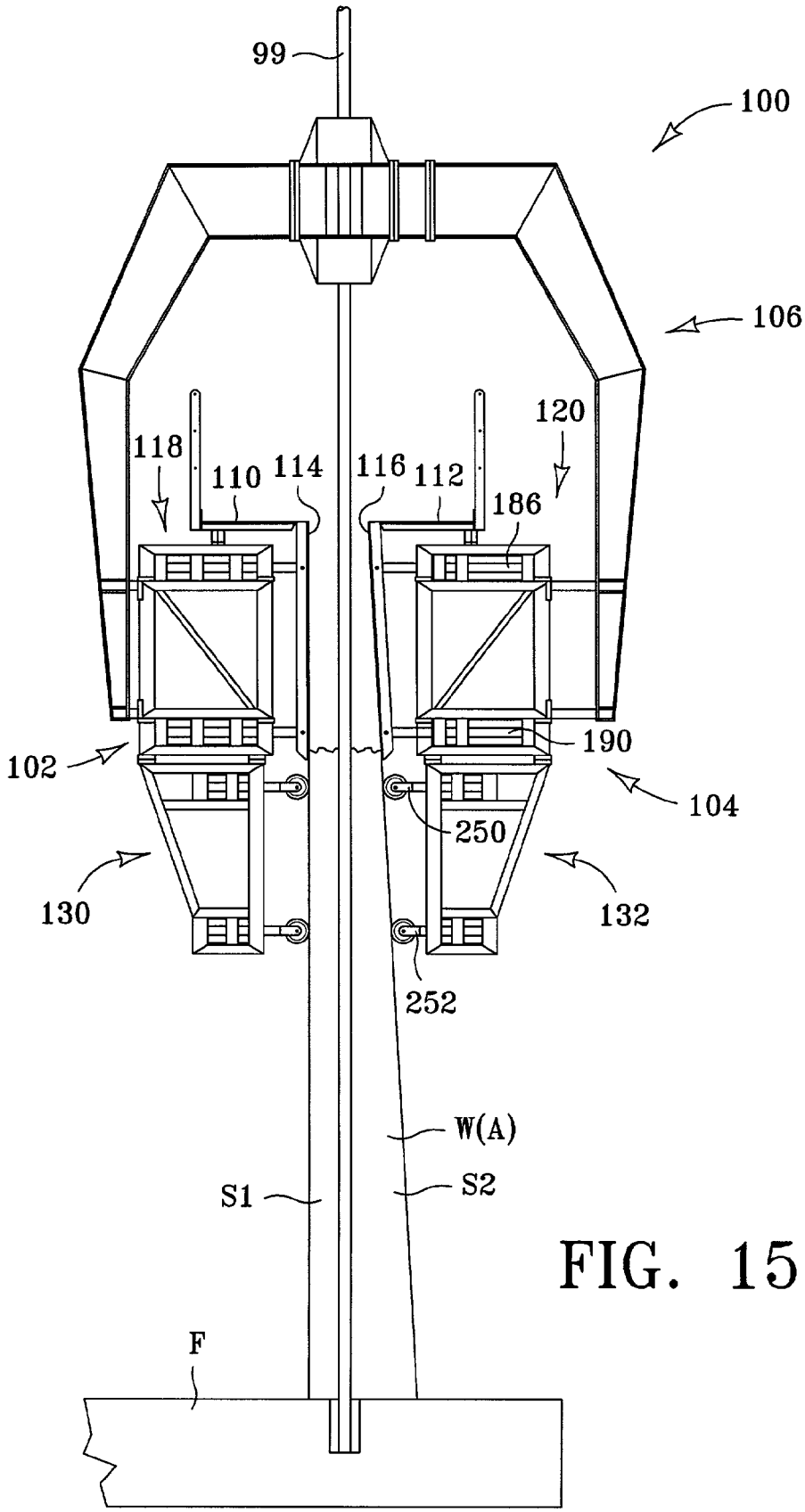
FIG. 15 is a side elevation view depicting how the apparatus depicted in FIG. 6 can be used to produce a vertical wall having one sloped side.
Figure 16:
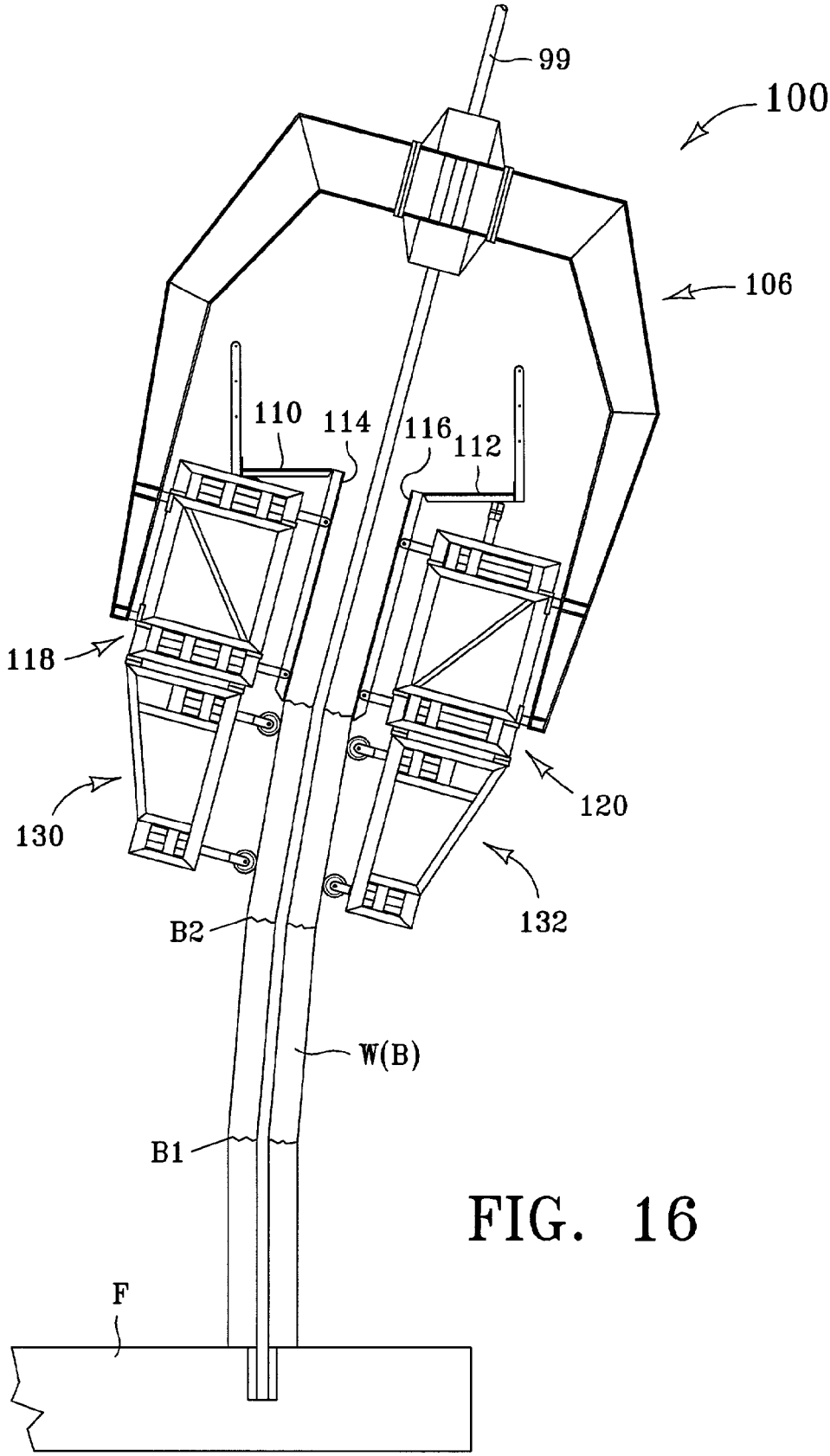
FIG. 16 is a side elevation view depicting how the apparatus depicted in FIG. 6 can be used to produce a curving vertical wall.

In operation, attitude control actuators 260 and 264 can be used to individually position the radial attitude positioning shafts 254 and 256, and thereby alter the position of the apparatus 100 with respect to the climb rod 99 (FIG. 6). Further, the attitude control actuators 260 and 264 (in radial control modules 130 and 132) can be used in conjunction to cause the attitude positioning shafts 254 and 256 to push the forms 114 and 116 towards or away from the evolving wall "W". Turning to FIG. 15, a side elevation view of the apparatus 100, similar to the depiction in FIG. 6, is shown. However, in FIG. 15 the apparatus 100 has been adjusted so that the wall "W(A)" being formed has a first side S1 which is essentially vertical, and a second side S2 which is a few degrees off of vertical. This produces a tapered wall "W(A)". To accomplish this, form positioning shafts 186 and 190 in truss module 120 have been adjusted to place form 116 in a slight tilted position. (It is noted that deck 112 is tilted with respect to form 116 to retain the work deck 112 in a level position.) Further, radial attitude positioning shafts 250 and 252 in radial positioning module 132 have been adjusted so that they contact the sloping side S2 of wall W(A), but keep the forming assembly 104 (other than form 116) oriented in a vertical position. Turning now to FIG. 16, yet another variation on the shape of a wall which can be formed using the apparatus 100 is depicted. In FIG. 16 the apparatus 100 is being used to form a wall "W(B)" having discrete bends B1, B2, etc. To accomplish the bends B1, B2, etc., the attitude control modules 130 and 132 are periodically readjusted to rotate the truss modules 118 and 120 (and thus forms 114 and 116) in a clockwise direction. Again, it is noted that work decks 110 and 112 remain level with respect to the foundation "F" so that workers can work on a level platform. In addition to the tapered wall "W(A)" of FIG. 15, and the staggered wall "(B)" of FIG. 16, it will be appreciated that the attitude control modules 130 and 132 can be used to generate a number of different wall shapes, including a double tapering wall (tapering either upward or downward), a straight but sloping wall, a continually curving wall, and a "stepped" wall (wherein the thickness of one or both sides of the wall are decreased (or, less commonly, increased) relative to a constant wall-thickness midpoint in a discrete, incremental manner.

Figure 14:
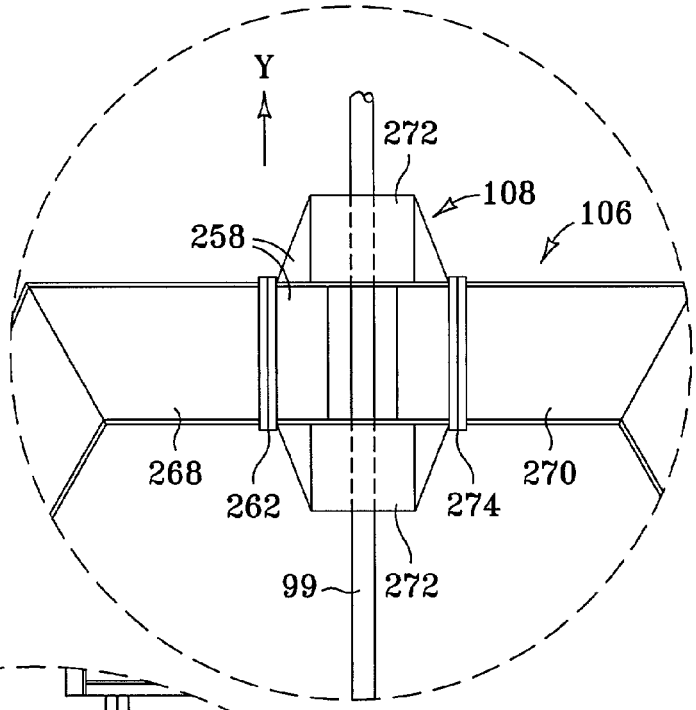
FIG. 14 is a side elevation view of a climb module that can be used in the apparatus depicted in FIG. 6.

Turning now to FIG. 14, a side elevation detail of the yoke jacking system 108 of FIG. 6 is depicted. The yoke jacking system 108 is connected to the first and second arms 268 and 270 of the yoke 106 by flanges 262 and 274. As depicted, the yoke jacking system 108 comprises a yoke actuator frame 258 which supports upper and lower climb actuators 272. Climb actuators 272 can be annular screw jacks or hydraulic jacks which can alternately grip the climb pipe 99 to effect upward movement the yoke 106 in direction "Y" along the axis of the climb pipe 99. Climb actuators 272 can be operated in discrete fashion to effect a "jump-form" type operation of the concrete forming apparatus 100, or they can be operated in a continual fashion to effect a continuous "slip-form" casting mode. Turning again to FIG. 8, as was described previously, the yoke 106 of FIG. 6 is attached to the truss modules 118 and 120 by yoke flanges 180.

Preferably, yoke 106 is pivotally attached to lower yoke flanges 180, and is adjustably connected to upper yoke flanges 180. This is depicted in FIG. 13, which shows a ball-joint type pivot hinge 273 which is placed between the lower yoke attachment bracket 180 and the lower end of the yoke arm 286. The yoke positioning device further comprises an actuator 275 which causes relative movement between the yoke 106 and the truss module 118. The preferred direction of movement is into and out of the plane of the sheet on which the figure is drawn. In this way, in a side view of the truss module 118 of FIG. 13, the yoke 106 can be moved pivotally in either a clockwise or a counter-clockwise rotational direction relative to the lower pivot connection 273. Since the yoke is anchored to the climb rod 99 (FIG. 14), the truss module 118 will be moved (rather than the yoke), allowing sway control of the apparatus 100 as the yoke actuators 272 move the apparatus 100 in the upward "Y" direction. As can be appreciated, a similar arrangement as that shown in FIG. 13 can be provided for truss module 120. In this way the climbing device 108 can be plumbed or adjusted in directions "R1" or "R2" with the attitude control modules and, in plan view, in directions orthogonal to "R1" and "R2" (i.e., into and out of the plane of the sheet on which FIG. 8 is drawn) with the tangential or sway control effected by actuator 275 acting about the lower ball-joint type pivot hinge 273 referenced to a predetermined reference point, such as a point on the ground, by using yoke adjustment devices. The yoke adjustment devices can be made additionally adjustable in the "R1" and "R2" directions to augment the attitude control effected by the attitude control modules 130 and 132, for example, with threaded nuts on a threaded shaft, wherein the nuts are placed between each yoke arm (268, 270) and each flange 180 in conjunction with sway control devices 273 and 275 so that the nuts can be used to urge the yoke arms in a direction ("inward" or "outward") relative to the flange 180. It will be appreciated that a further means of tangential or sway control (i.e., in a direction into and out of the plane of the sheet upon which FIG. 8 is drawn) can be accomplished in a global or system sense by attitude control modules 130, 132 of associated forming apparatus 100 oriented with a vector component in the direction of the sway of climbing device 108 into or out of the plane of the sheet upon which FIG. 8 is drawn. As an example, the attitude control modules stabilizing yokes 106B and 106D in localized directions "R1" and "R2" along the short sides of system 400 of FIG. 20, especially near the corners, can accomplish the sway control of yokes 106A and 106C along the long sides of system 400. In a like manner, the attitude control modules stabilizing the yokes 106A and 106C in localized directions "R1" and "R2" along the long sides of system 400, especially those nearest the corners, can accomplish the sway control of yokes 106B and 106D along the short sides of system 400.

Figure 18:
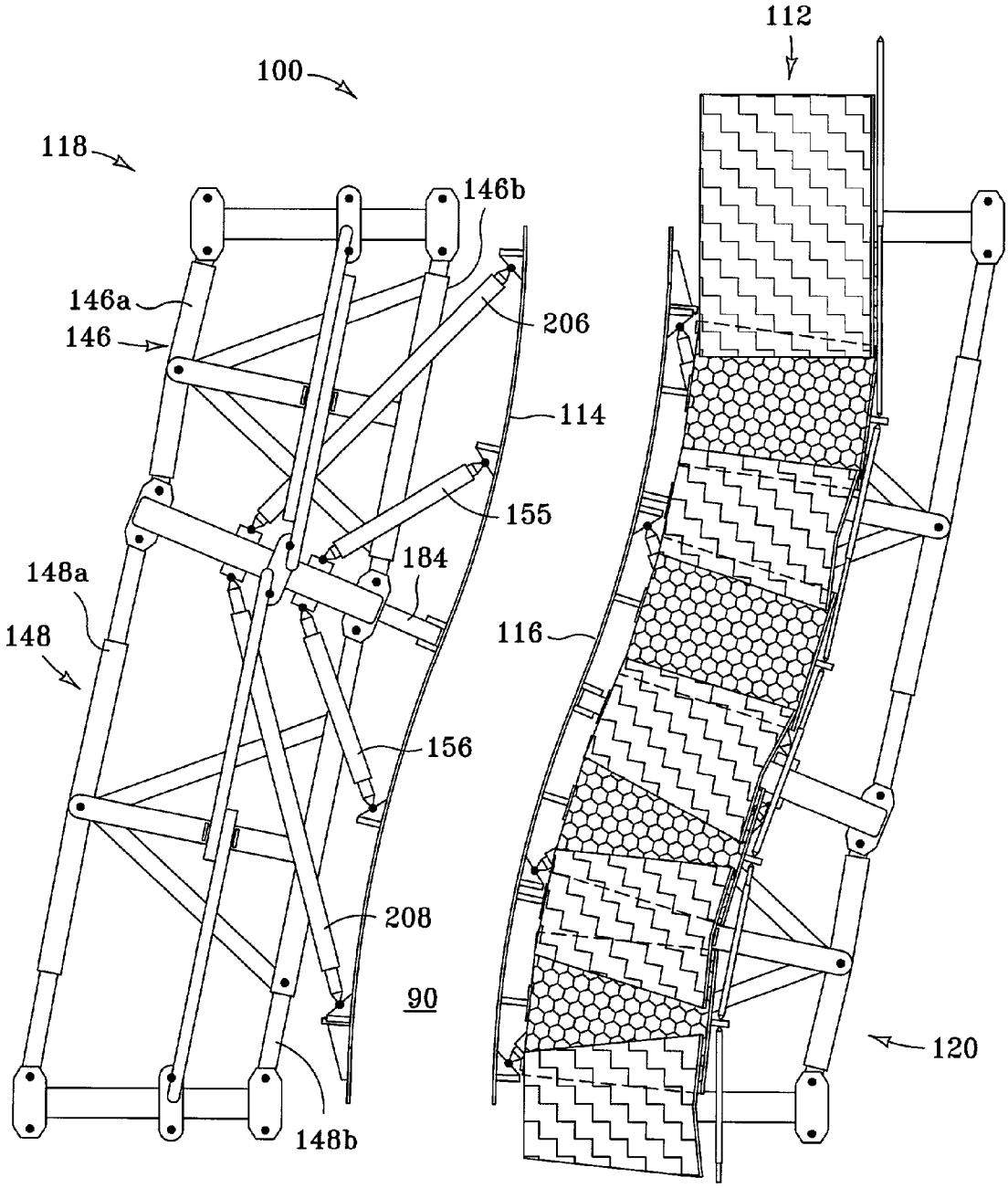
FIG. 18 is a plan view depicting how the truss modules depicted in FIG. 7 can be formed into a compound curve concrete forming shape.

As previously discussed, FIG. 17 shows how the truss modules 118 and 120 can be configured using the adjustable struts (155, 156, 206, 208, 158, 160, 210, 212, etc.) and the space-frame adjustable links (234, 236), described above, for placing the apparatus 100 in a radial arc shape. By connecting several so-shaped apparatus 100 together, a closed-circle concrete forming apparatus can be formed, and the assemblage of the discrete concrete forming apparatus into the closed-circle concrete forming apparatus can then be used to generate a vertical silo. Turning to FIG. 18, another shape into which the apparatus 100 be can be configured is depicted in plan view. In FIG. 18 the truss modules 118 and 120 have been adjusted to place the forms 114 and 116 into parallel compound curves, so that when the void area 90 defined between the forms is filled with concrete, a portion of the concrete structure 30 of FIG. 5 will be produced. As can be observed in FIG. 18, adjustable links 146*a* and 148*a* of respective space frames 146 and 148 are adjusted to different lengths (as are the forward adjustable length members 146*b* and 148*b*). Likewise, the inner struts ("form-shaping members") 155 and 156 are set to different lengths, as are the outer struts 206 and 298. From this observation it is apparent that the face of each form (114, 116) can be set to a separate shape about the form-shaping member (e.g., 184, FIG. 18) when separately adjustable space-frame links (e.g., 146*a*, 146*b*, 148*a* and 148*b*) are used in conjunction with separately adjustable form-shaping members (e.g., struts 155,156,206 and 208).

Figure 23:
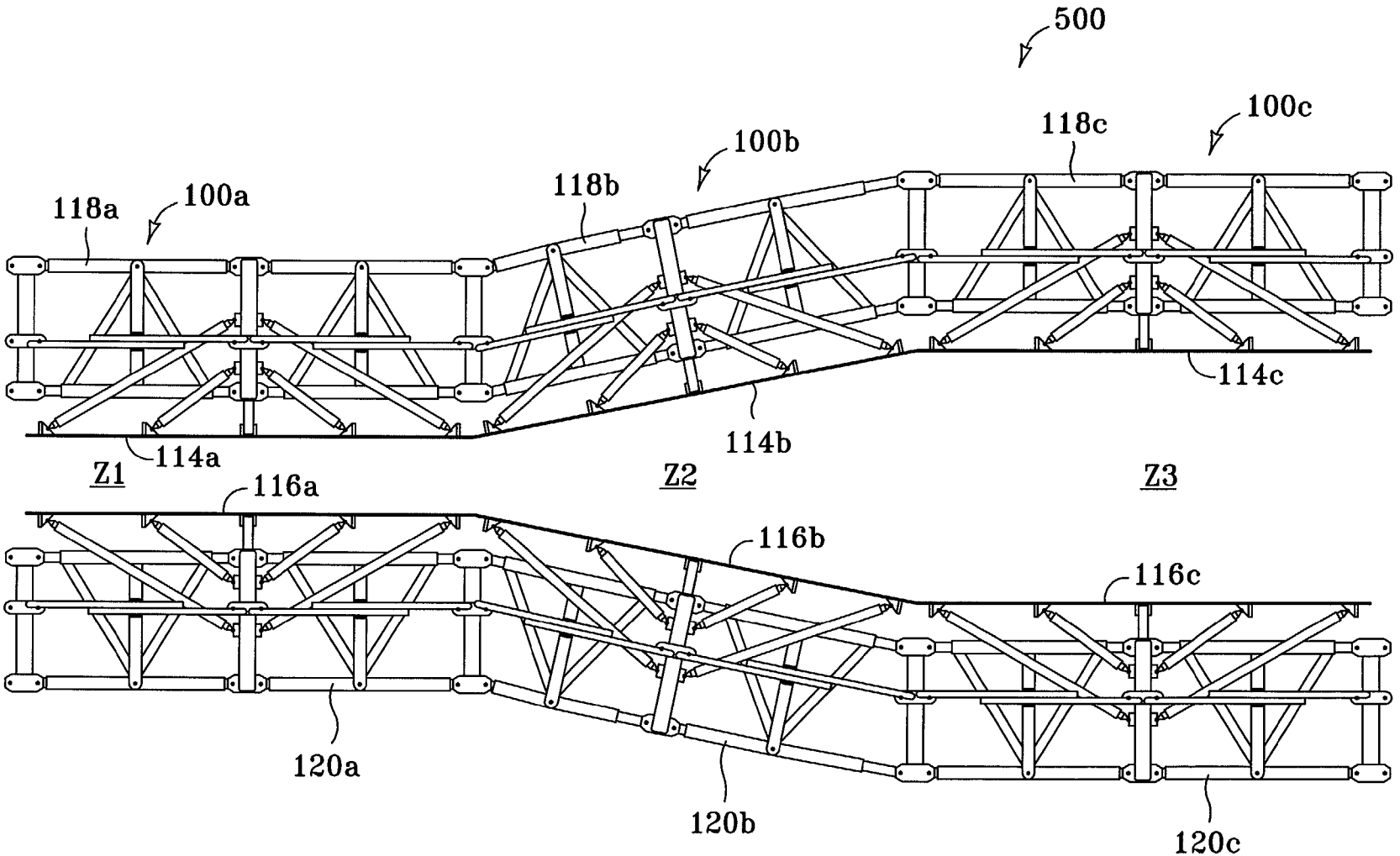
FIG. 23 is a plan view depicting how several of the apparatus depicted in FIG. 6 can be joined together to form a system for producing a transition tapered vertical concrete structure.

Turning briefly to FIG. 23, a plan view showing three of the apparatus 100 of FIG. 6 joined together is depicted. The truss modules 118*a* and 120*a* of apparatus 100*a* are adjusted to place the respective forms 114*a* and 116*a* in parallel, straight orientation with respect to one another, generating straight pour zone Z1. Truss modules 118*b* and 120*b* of apparatus 100*b* are connected at an angle to respective truss modules 118*a* and 120*a*. Further, truss modules 118*b* and 120*b* are adjusted to place respective forms 114*b* and 116*b* in non-parallel orientation with respect to one another, resulting in the widening taper zone Z2. Finally, truss modules 118*c* and 120*c* of apparatus 100*c* are connected at an angle to respective truss modules 118*c* and 120*c*. Truss modules 118*c* and 120*c* are adjusted to place respective forms 114*c* and 116*c* in parallel orientation with respect to one another, resulting in a second straight zone Z3. In this way a wall of variable width (in the plan view) can be constructed. As can be seen by viewing FIGS. 15 through 18 and 23, and as will be described fuller below, it is apparent that by adjusting the truss modules on the apparatus 100 to various shapes, and by connecting several of the apparatus 100 together, and using the attitude control modules 130 and 132 (FIG. 6), an almost infinite variety of shapes of concrete structures can be formed by using one or more of the apparatus 100 of the present invention. For example, a curved, tapered open-form structure such as a dam can be continuously formed. Also, a closed-form, circular structure having a domed concrete roof, such as a nuclear power plant, can also be formed. Likewise, a sound wall adjacent a freeway can be produced, the sound wall having periodic undulations (such as in FIG. 5) to break up sound, and having local undulations to follow the path of the freeway.

Figure 19:
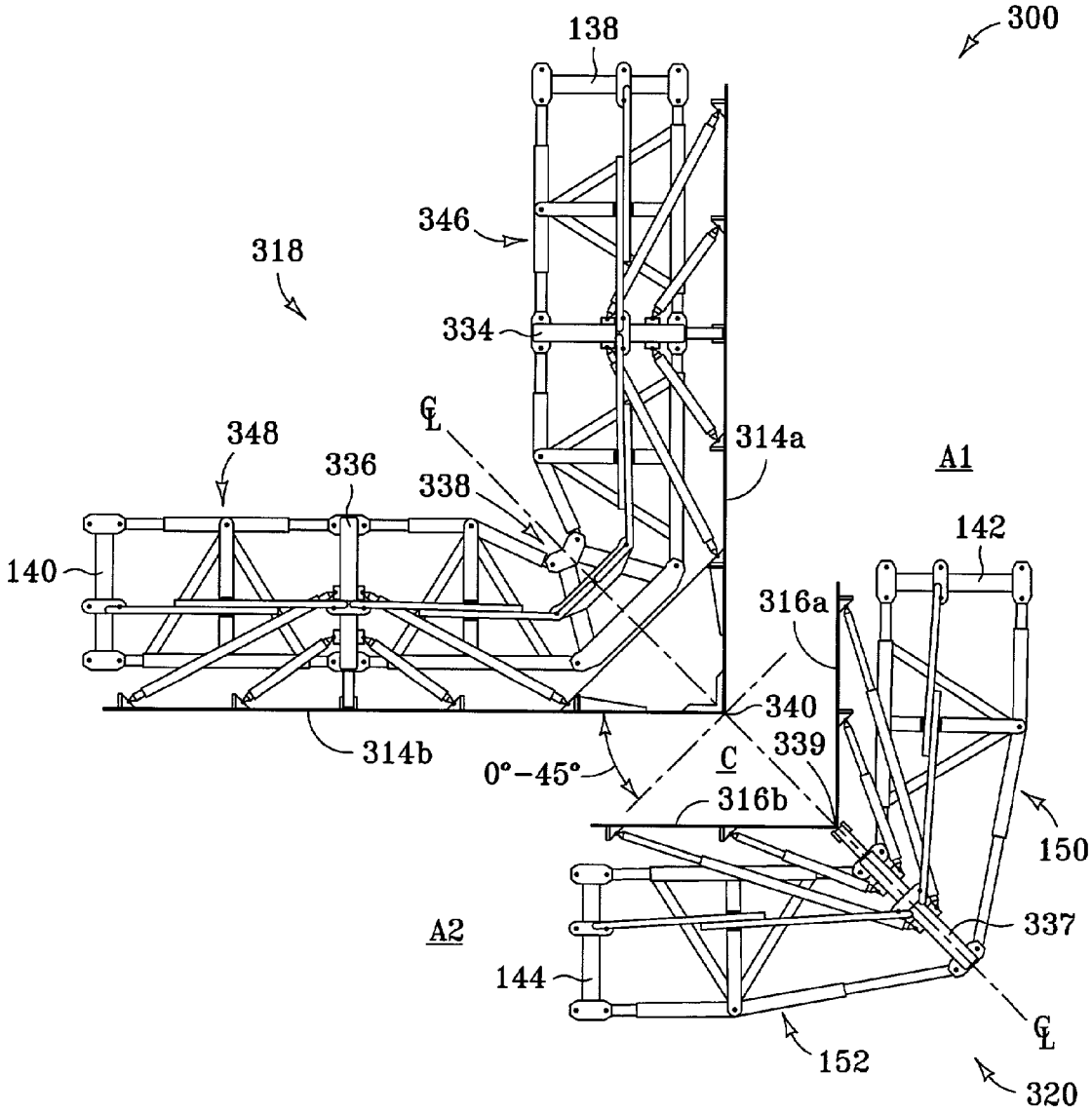
FIG. 19 is a plan elevation view of truss modules of a concrete forming apparatus of the present invention that can be used to form corners in vertical concrete structures.

In addition to the standard concrete forming apparatus 100 depicted in FIGS. 6 through 12, specialized concrete forming apparatus can be provided, in accordance with the present invention. FIG. 19 depicts one such specialized apparatus 300. The apparatus 300 of FIG. 19 is shown in a plan view, and the yoke (106, FIG. 6) and work-decks 110, 112 (FIG. 6) have been removed for clarity. The apparatus 300 of FIG. 19 is specially constructed to form corners of a concrete structure, and includes a first truss module 318 which supports forms 314*a* and 314*b*, and a second truss module 320 which supports forms 316*a* and 316*b*. As can be seen, truss module 318 is longer than truss module 320. Accordingly, shortened truss modules (similar to module 120 of FIG. 7, but having only a single set of upper and lower struts) can be connected to end frames 142 and 144 of truss module 320 in respective areas A1 and A2, so that the end frames of the shortened truss module 320 will align with the end frames 138 and 140 of truss module 318. Truss module 318 essentially comprises two of the truss modules 118 (FIG. 7) joined together at a truss pivot assembly 338. That is, truss module 318 comprises space frame and strut assemblies 346 and 348 which are joined together at truss pivot assembly 338. Truss sub-module 346 supports form section 314*a*, and truss sub-module 348 supports form section 314*b*. Form sections 314*a* and 314*b* are hingedly joined at hinge 340, allowing the form sections 314*a* and 314*b* to form a sharp angle, rather than a curved shape (as in FIG. 17). Likewise, truss module 320 comprises standard space frames 150 and 152, as described above, but space frame 150 supports form section 316*a*, while space frame 152 supports form section 316*b*. Form sections 316*a* and 316*b* are hingedly joined at hinge 339, allowing the form sections 316*a* and 316*b* to form a sharp angle. The form sections 314*a*,314*b*,316*a* and 316*b* together form a corner area "C". If a sharp outside corner is not desired, then a rounding form can be placed between form sections 316*a* and 316*b* to round the corner. Each space frame 346, 348 of truss module 318 of the corner forming apparatus 300 can be articulated at least 45 degrees about a centerline "CL" which joins form hinges 340 and 339, and likewise each space frame 150, 152 of truss module 320 can be articulated at least 45 degrees about the centerline "CL". In this way corners of varying angles can be produced with the corner forming apparatus 300.

Figure 20:
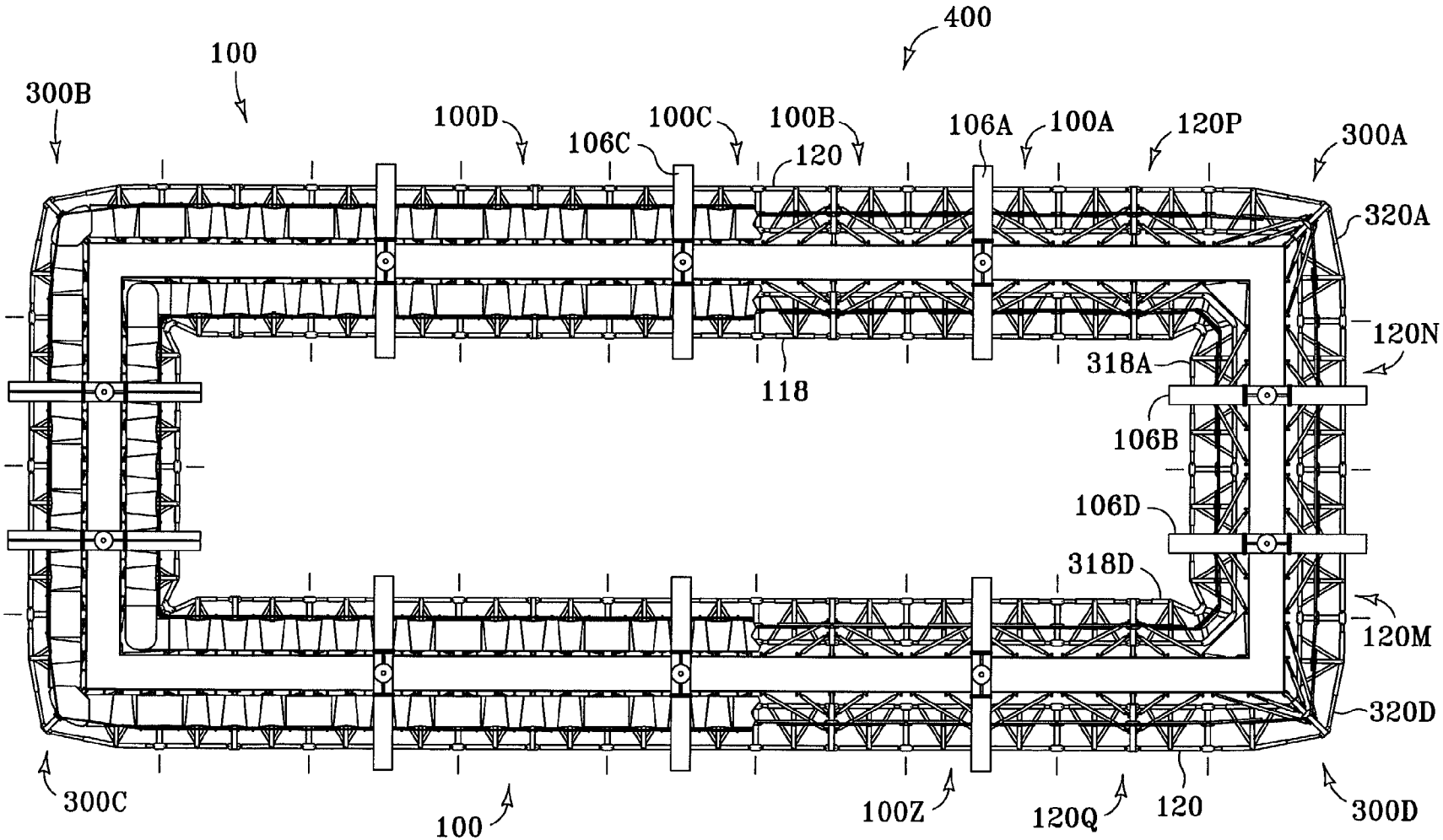
FIG. 20 is a plan view of an assembly of apparatus of the present invention assembled to form a vertical, rectangular concrete structure.

Since actuator frame 337 of truss module 320 of FIG. 19 does not have a corresponding actuator frame in the truss module 318, the yoke assembly (such as 106 of FIG. 6) which is used to lift the apparatus 300 upward along the climb rod (e.g., climb rod 99 of FIG. 6) is preferably located where two actuator frames correspond (i.e., where two actuator frames are located adjacent one another between truss modules). Turning to FIG. 20, a plan view of a system 400 of a concrete structure forming apparatus in accordance with the present invention is depicted. The system 400 is generally configured to produce a rectangular, vertical concrete structure. The system 400 comprises four corner forming apparatus 300A, 300B, 300C and 300D. It is noted that corner forming apparatus 300A and 300B are joined along the long-dimensioned side of the rectangular form 400 by straight forming apparatus 100A, 100B, 100C, 100D, and so on. At the short-dimensioned sides of the rectangular form 400, truss modules 318A and 318D of corner forming apparatus 300A and 300D are joined directly together. However, the truss modules 320A and 320D of corner forming apparatus 300A and 300D are not joined directly together, but instead are provided with supplementary truss modules 120N and 120M. Likewise, whereas truss modules 318A and 318D are joined to respective straight forming apparatus 100A and 100Z, supplementary truss modules 120P and 120Q are provided to allow the outside truss modules 320A and 320D of corner-forming apparatus 300A and 300D to connect to the straight forming apparatus 100A and 100Z. As can also be seen in FIG. 20, each concrete forming apparatus that comprises part of the overall system 400 is not necessarily provided with a yoke. Specifically, along the long-dimensioned sides of the rectangular shape 400 only every other straight forming apparatus is provided with a lifting yoke (e.g., apparatus 100A and 100C are provided with respective yokes 106A and 106C, while forming apparatus 100B and 100D are not provided with yokes). However, along the short-dimensioned sides of the rectangular form 400, yokes 106B and 106D are connected to respective inner truss modules 318A and 318D, as well as to respective outer supplemental truss modules 120N and 120M. As can be seen by the example provided in FIG. 20, the number and location of yokes provided in any concrete forming system which includes concrete forming apparatus of the present invention will be governed by considerations such as the thickness of the concrete structure being formed and the final shape of the structure. The number and location of yokes will also be governed by: (1) resolving the hydrostatic forces of concrete exerted on the forms (114, 116) over the span of the truss modules (118, 120) to the yokes (106); (2) the gravity loads supported by each truss module 118, 120 (e.g., the loads on the work decks 110, 112); and (3) the stability of the overall concrete-forming system as the weight of the system bears on the climb rods (99).

Figure 21:
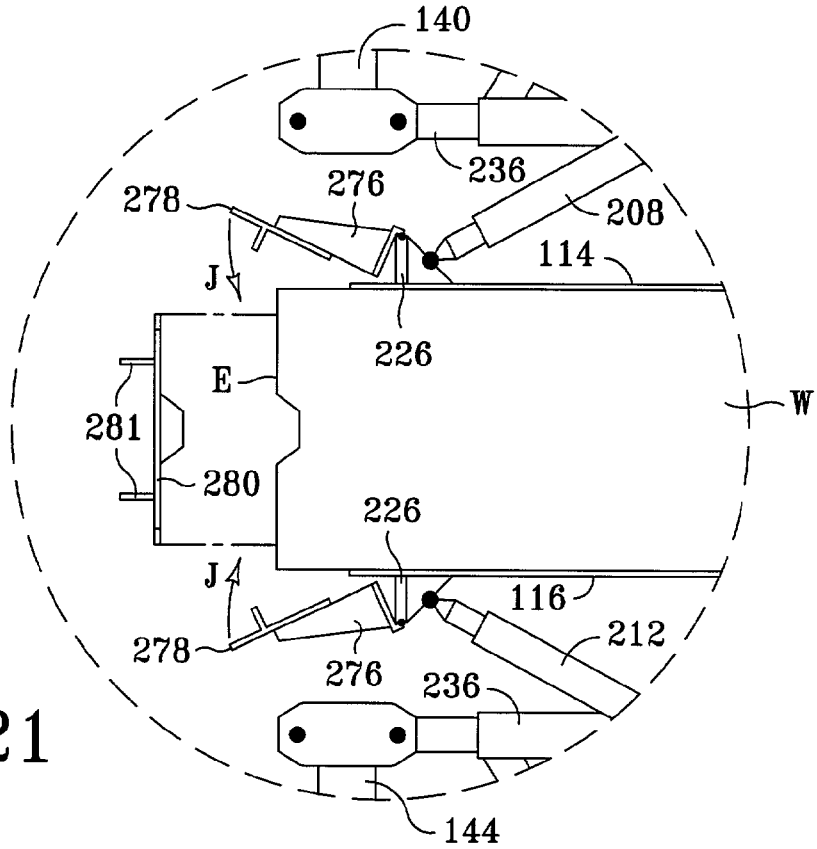
FIG. 21 is a plan view depicting how the apparatus depicted in FIG. 6 can be adapted to form a concrete segment using an adjacent, similar apparatus.

Turning to FIG. 21, a plan view of a modification to the concrete forming apparatus 100 of FIG. 6 is depicted in plan view. FIG. 21 shows how the apparatus 100 can be adapted with an "end-of-segment" adapter, which can be used when the apparatus 100 is operated in a segmental casting mode. The end-of segment adapter includes a segment end plate 280 which is used to close the void area (90, FIG. 6) between forms 114 and 116 as the structure of wall "W" is being formed. End plate 280 (FIG. 21) has securing tabs 281 provided on the outside thereof. The segment end plate 280 is depicted in FIG. 21 as being pulled slightly away from the end face "E" of the wall "W" merely to illustrate operation of the end-of-segment adapter. The end plate 280 is preferably the same height as the forms 114 and 116. Hingedly attached to form brace members 226 are form extenders 276, which each have an end plate securing bracket 278 attached thereto. Securing brackets 278 and end-plate securing tabs 281 are each provided with holes (not shown) which will align when the end plate 280 is placed in position (to form end "E" of wall "W") and form extenders 276 are rotated in directions "J". A securing pin (not shown) can then be placed through the aligned holes in tabs 281 and securing brackets 278 to secure the end plate 280 in position. After a formed segment of wall "W" has been cured, the end plate 280 is removed by removing the securing pins and rotating the form extenders 276 outward to the position shown in FIG. 21.

Figure 22:
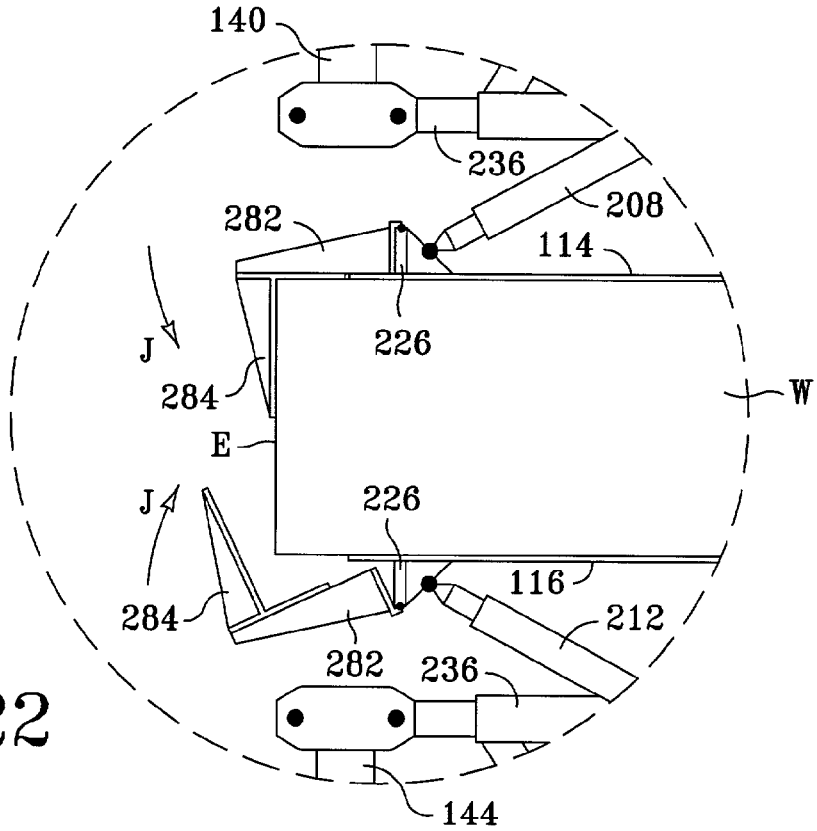
FIG. 22 is a plan view depicting how the apparatus of FIG. 6 can be adapted to form the end of an open-form vertical concrete structure.

Turning to FIG. 22, a plan view of another modification to the concrete forming apparatus 100 of FIG. 6 is depicted in plan view. FIG. 22 shows how the apparatus 100 can be adapted with an "end-of-form" adapter, which can be used when the apparatus 100 is used to form the end segment of an open-form structure. The end-of-form adapters include end-of-form extenders 282 which are hingedly attached to form brace members 226. Each end-of-form extender 282 includes an end-form 284. When the end-of-form extenders 282 are rotated in directions "J", the end-forms 284 will cover the area "E" which will define the end of the structure "W". The end-of-form extenders 282 can be held in the "closed" position by the use of bolts or pins which can pass through mating tabs (not shown) on the end-forms 284.

Although I have described above a specific embodiment of a concrete forming apparatus of the invention, it will be appreciated that another embodiment of the present invention provides for a concrete forming module (such as 102 of FIG. 6) which can be used to retract concrete forms away from a concrete structure (or a partial concrete structure) which has been formed, or to move concrete forms into place to form a concrete structure. The module 102 includes a concrete form (114, FIG. 6) and a first actuator frame 134. The module 102 further includes a first form-translating actuator 200 which is supported by the actuator frame 134. A first elongated form-translating member (shaft 184), which is engaged by the form translating actuator 200, has a first end connected to the form 114. The form-translating actuator 200 is configured to move the form-translating member 184 relative to the actuator frame 134, to thereby translationally move the form 114 relative to the actuator frame 134. Preferably, the module 102 further includes a second actuator frame 174 which is spaced-apart from the first actuator frame 134, and connected to the first actuator frame, by a main frame 248. In this case the module 102 has a second form-translating actuator (200) supported by the second actuator frame 174, and a second elongated form-translating member (shaft 188) having a first end connected to the form 114 proximate a lower edge of the form (the first translating member 184 being connected to the form 114 proximate an upper edge thereof). The second form-translating member 188 is engaged by the second form-translating actuator 200 (lower), and the second form translating actuator (lower 200) is configured to move the second form-translating member (188) relative to the second actuator frame 174. Preferably, when two form translating actuators (200 upper and lower) are provided, the first and the second form translating members (184, 188) are each connected to the form 114 by a hinged connector (e.g., pin 192), allowing the form to "tilt", such as indicated by 116*a* in FIG. 8.

The concrete forming module 102 can further include a first space frame (146, FIG. 7) connected to the first side of the actuator frame 134, and a second space frame 148 connected to the second side of the actuator frame. A first end-frame 138 can be connected to the first space frame 146 distal from the actuator frame 134, and a second end-frame 140 can be connected to the second space frame 148 distal from the actuator frame 134. A work deck 110 (FIG. 6) can be supported by the actuator frame 134 and the first and second end frames (138, 140).

Yet another embodiment of the present invention provides for a concrete forming module (such as module 102) which can be used to shape a semi-flexible concrete form into a curvilinear shape to thereby allow casting of various geometries of structures, all using the same form module. The concrete forming module 102 includes a semi-flexible concrete form (such as form 114, which can be made of steel of a sufficient thinness that it can be resiliently deformed into a desired shape). The module 102 includes an actuator frame (such as frame 134, FIG. 7), and a form-shaping actuator supported by the actuator frame. The form-shaping actuator can be any of actuators 196, 198 or 200. The module 102 further comprises an elongated form-anchoring member (such as shaft 184) having a first end connected to the form 114 at an anchor point (e.g., at pin 192, FIG. 8). The form-anchoring member 184 is connected to the actuator frame 134. This connection of the form-anchoring member 184 to the actuator frame 134 can be either a fixed connection, or a moveable connection. The module 102 further includes a form-shaping member (such as strut 155, 156, 206 or 208 of FIG. 7) having a first end connected to the form 114 (as at form support members 222, 224, 224 or 228 of FIG. 10), and a second end connected to the form shaping actuator (e.g., 196, 198 or 200). The connection of the form-shaping member (e.g., strut 155, 156, 206 or 208) to the form shaping actuator (e.g., 196, 198 or 200) can either be direct, as in the case of actuators 196, 198 (FIG. 8), or indirect, as in the case of actuator 200 (where the connection is through the form-anchoring member (shaft 184)). The form-shaping actuator (196, 198 or 200) is configured to produce relative movement between the second end of the form-shaping member (e.g., the end of strut 155 which is closest to the actuator frame 134, as seen in FIG. 7) and the anchor point (e.g., pin 192, FIG. 8) to thereby urge the form 114 into a curvilinear shape.

In this latter embodiment the form-shaping actuator can be configured to move within the actuator frame to effect movement of the second end of the form-shaping member (e.g., strut 155) relative to the anchor point (e.g., pin 192). Specifically, actuator 196 or 198 can be used in the manner described above, wherein the "form-anchoring member" (shaft 184) is held stationary by actuator 200, so that actuation of the jack-screw actuator (196 or 198) causes the actuator 196, 198 to move within the actuator frame 134 on guides 194 (FIG. 8). Alternately, the form-shaping actuator can be configured to move the elongated anchor member relative to the actuator while the actuator remains stationary. This can be accomplished by using actuator 200 to move the "form anchoring member" (shaft 184) relative to the actuator frame 134.

Figure 25:
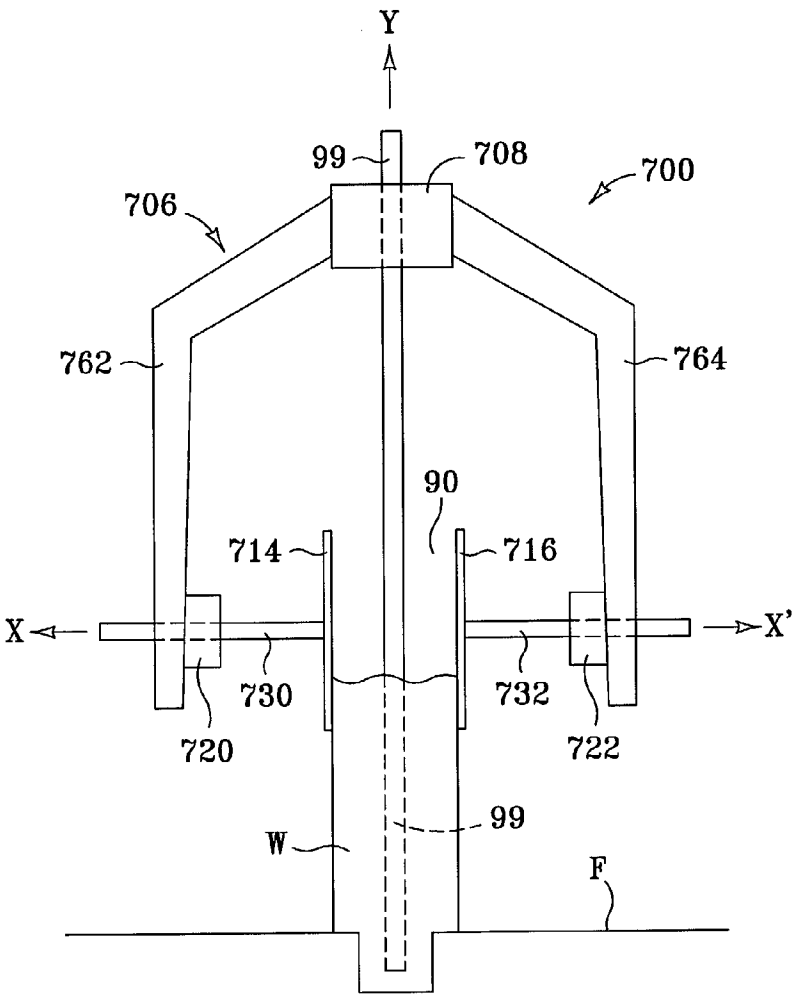
FIG. 25 depicts a side elevation view of yet another embodiment of an apparatus in accordance with the present invention.

A further embodiment of an apparatus 700 in accordance with the present invention is depicted in a side elevation view in FIG. 25. The concrete forming apparatus 700 of FIG. 25 comprises a first form 714 and a second form 716 placed in generally parallel, spaced-apart relationship with one another to thereby form a concrete-receiving void 90. The apparatus 700 further includes a yoke 706 comprising a first arm 762 and a second arm 764. A first-form-translating member 730 is connected to the first form 714 and is in moveable relationship to the yoke first arm 762. A first-form translating actuator 720 is configured to move the first-form-translating member 730 relative to the yoke first arm 762. The apparatus 700 can further include a second-form-translating member 732 connected to the second form 716, and in moveable relationship to the yoke second arm 764 by virtue of a second-form translating actuator 722 configured to move the second-form-translating member 732 relative to the yoke second arm 764. A climbing device 708 (similar to climbing device 108 of FIG. 6) can be provided to allow the yoke 706 to move upwards in direction "Y" as concrete wall "W" is formed on foundation "F".

Figure 26:
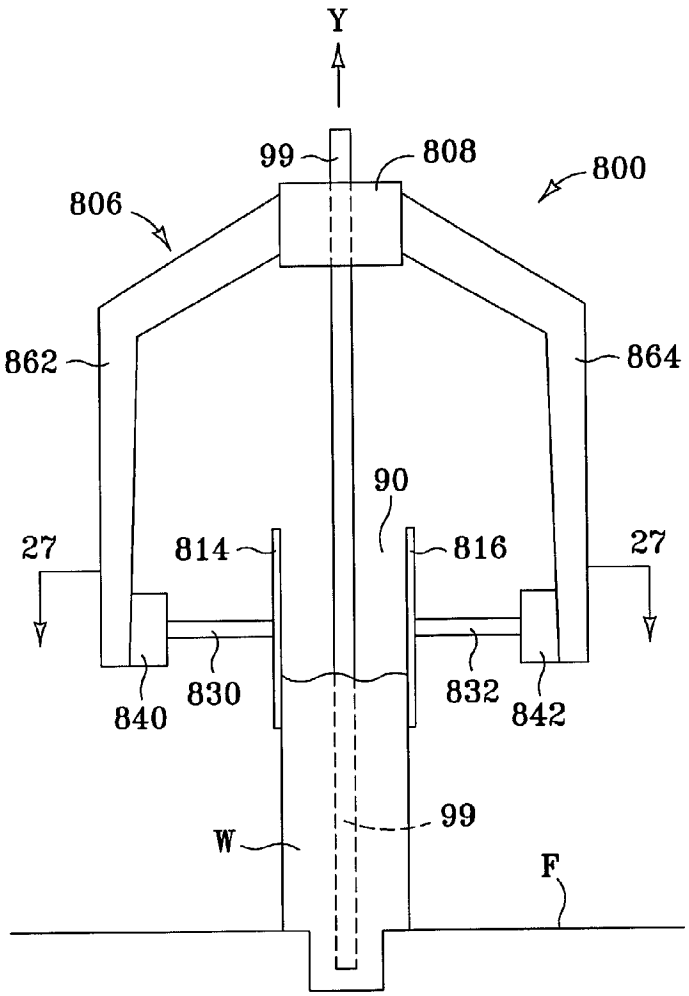
FIG. 26 depicts a side elevation view of a further embodiment of an apparatus in accordance with the present invention.

Another embodiment of an apparatus 800 for forming concrete structures in accordance with the present invention is depicted in a side elevation view in FIG. 26. The apparatus 800 of FIG. 26 includes a first form 814 and a second form 816 placed in generally parallel, spaced-apart relationship with one another, as well as a yoke 806 comprising a first arm 862 and a second arm 864. A first-form-shaping member 830 having a first end connected to the first form 814 and a second end in moveable relationship to the yoke first arm 862 is also provided. The apparatus 800 can further include a first-form-shaping actuator 840 configured to move the second end of the first-form-shaping member 830 relative to the yoke first arm 862. The apparatus 800 can also include a second-form-shaping member 832 having a first end connected to the second form 816 and a second end in moveable relationship to the yoke second arm 864. When a second form-shaping member 832 is provided, the apparatus 800 can further include a second-form-shaping actuator 842 configured to move the second end of the second-form-shaping member 832 relative to the yoke second arm 864. The first-form shaping member 830, as well as the second form-shaping member 832, can comprise adjustable-length struts configured to move the first end of the first-form-shaping member relative to the yoke first arm.

Figure 27:
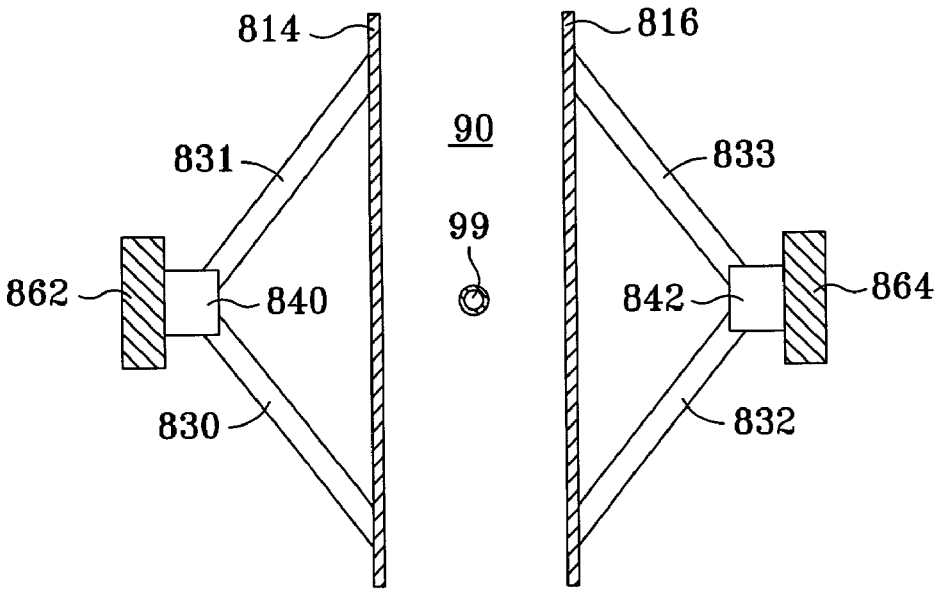
FIG. 27 depicts a plan elevation sectional view of the apparatus depicted in FIG. 26.

FIG. 27 depicts a plan sectional view of the apparatus 800 of FIG. 26, and shows how the form-shaping members 830 and 832 can be connected to the respective forms 814 and 816, as well as the respective form-shaping actuators 840 and 842. FIG. 27 also shows that forms 814 and 816 can be further provided with respective first-form and second-form secondary form shaping members 831 and 832, which can be connected to respective first- and second-form shaping actuators 840 and 842. As indicated in FIGS. 26 and 27, the yoke 806 of apparatus 800 can include a climbing device 808, allowing the apparatus 800 to ascend in the upward "Y" direction along climb rod 99. By sharing forms 814 and 816 using the form-shaping members 830 and 832, a shaped structure "W" (such as wall 22 of FIG. 3, or of FIG. 5) can be formed on the foundation "F".

I will now describe how the apparatus described above can be operated.

I) Mobilization-Demobilization

Concrete forming apparatus of the present invention, such as apparatus 100 of FIG. 6, will typically be mobilized to and from a construction site in a state of advanced assembly. Several standard modules 102, 104 can be connected in a chain (as in modules 100A, 110B, 100C of FIG. 20) and transported in a straight format on a semi-trailer with the opposed form faces (114, 116) set closely together and the actuator shafts (184, 186, 188, 190 of FIG. 8) retracted fully into the actuator frames (134, 136, 174, 176) to minimize the width of the module pair (102, 104). Yokes 106 can be shipped in halves (e.g., arms 268 and 270 of FIG. 14 shipped separately), with the jacking subassembly 108 attached to one of the frame halves. Climb pipes 99 (FIG. 6) can be stacked as pipe. Attitude control modules 130 and 132 (FIG. 6) and other components can be stacked on pallets.

II) Set-Up

Each module chain (comprised of several standard apparatus modules 102, 104 in opposed pairs) can be lifted as a unit off of a semi trailer onto the foundation "F" (FIG. 6) or nearby on a flat, level surface. These module chains can then be manually configured, module-by-module, into the intended geometric format that will effect the reinforced concrete wall or shell segment of the structure, or an entire structure such as shown in FIG. 20. Actuation of the modules 102, 104 into the desired geometry is accomplished by setting struts (155, 156, 206, 208, 158, 160, 210 and 212) to a predetermined length and setting strut actuators (196, 198) to the predetermined location along actuator shafts (184, 186, 188, 190). The adjustable links (234, 236, FIG. 11) of the space frames ((146, 148, 150, 152, FIG. 7) are allowed to telescope relative to one another during this actuation process to set the form geometry. Extender form adaptors such as 372 (FIG. 17B) and end-of-wall adaptors 282 (FIG. 22) can then be attached to the required form ends. Any required incremental length modules (e.g., 120M, 120N, 120P and 120Q of FIG. 20) are inserted within and between the various module chains to effect the exact curvilinear structural length desired. The adjustable links 234, 236 (FIG. 11) of the truss modules 118, 120 can then be locked in place to freeze the structural shape. These module chains are then lifted into place straddling the foundation dowel rebar (which typifies the base of most reinforced concrete structures), and typically also a form height of completely-installed horizontal structure reinforcing steel ("rebar") (since there is little or no access to install this reinforcing steel after the forms 114, 116 are in place). As these module chains and individual modules are landed on the foundation, they can be rough-leveled. The free ends of the module chains and individual modules are then pinned together with pins at common end frame anchor flanges 199 (FIG. 11), adjoining work deck panels (such as 296, FIG. 17A) are set in place, and the adjoining handrail is attached together. After the entire segment length (or whole structure length) of modules 102, 104 are in place and pinned together, the modules are then fine-leveled (or set to a desired wall slope) by shimming under each flange of the end frames (e.g., 142, 144) and under the actuator frames (134, 136). Yoke modules 106 are then lowered into place at their prescribed support location along the jump-slip form system (see FIG. 20, for example) and are attached and plumbed radially to a reference point, such as the end frame pairs (140, 144 of FIG. 7), a pair of actuator frames (134, 136) or at the frame support points (180, FIG. 8). The yokes 106 are then plumbed tangentially to the truss modules 118, 120 by adjusting the upper support point (proximate upper flange 180) relative to lower support point (proximate lower flange 180). Next, a climb pipe 99 (FIG. 6) is lowered down through the yoke jacking assembly 108 to the foundation "F". The initial climb pipe 99, as well as subsequent spliced climb pipes, can be sized to stick up above the top of the yoke 106 by several form heights, so as to reduce the frequency of splicing subsequent climb pipes. The climb pipe 99 is plumbed tangentially (into or out of the plane of the sheet upon which FIG. 8 is drawn), and plumbed radially (in directions "R1" and "R2" of FIG. 8) (or set to a predefined radial slope for sloped walls), inherently by its reference to the bores on the upper and lower yoke jacks (272, FIG. 14) through which the climb pipe 99 has been placed. Next, modular power and control units are mounted along the work decks (110, 112, FIG. 6) and connected to the truss module actuators (196, 198, 200), the attitude control module actuators (260, 264, FIG. 13), yoke jacks 272, and GPS or other geometric monitoring and control systems. Any other support subsystems such as, but not limited to, welder leads, cutting torch gas lines, and climate control lines (forms can be provided with a climate control system to facilitate hot and cold weather concreting) can also be attached between modules 102 and 104 at this time. The final activity before beginning construction of the reinforced concrete structure is to prepare the forms with a release agent, and globally actuate the forms 114, 116 into place relative to the support truss structures 118 and 120. To insure a proper preload between the forms (114, 116) and support truss modules (118, 120) on the initial concrete lift (when in discrete casting mode), the bottom back edge of the forms (114, 116) at their middle and ends is preferably braced to the concrete foundation "F" (FIG. 6) with concrete anchors. Subsequent preload (for the discrete casting mode) is accomplished by thrusting the bottom edge of the form face 114, 116 against the top edge of the evolving concrete structure (such as wall "W", FIG. 6) after it has achieved adequate strength. The preload can compensate for deflection or "bulging" of the forms 114, 116 due to the hydrostatic forces of the liquid concrete as it is deposited between the forms.

III) Operation

There are two primary modes of operation of the apparatus of the present invention: discrete casting and continuous casting, which are performed by the apparatus to achieve either vertical segmental casting of discrete concrete segments, or casting of the entire structure all-at-once. I will now describe each of these modes separately.

a) Discrete Casting Mode

The set-up (described above) will have generally prepared the apparatus 100 for casting the first lift or jump of concrete, lifts being typically the form height in classical jump-forming, but in the case of the "jump-slip machine" (apparatus 100, or 400 for example), the forms on subsequent lifts are overlapped somewhat with the previous pour to allow preloading of the forms against the cured concrete, and to effect smoother, less noticeable, horizontal joints than is typically the case for prior-art jump forming wherein the forms are placed directly above one other (with no overlap). Prior to pouring concrete, any block-outs (e.g., door, windows, etc.) or embedments are placed between the forms 114 and 116, and fastened to the form faces with fasteners, and any spreaders (as discussed below) are attached to the forms 114, 116. The first "lift" is then poured into the void area 90 (FIG. 6) between the forms (114, 116) by way of a concrete pump truck trunk or a concrete bucket, and then vibrated until the form height is achieved. Although the support truss modules (118 and 120) and yoke system 106 will generally be relatively rigid and will have been preloaded by the actuators (196, 198) relative to the form modules (114, 16) to achieve tight geometric thickness control of the concrete section, even tighter dimensional tolerances at the top of forms 114, 116 can be achieved by placing rigid steel spreaders at stiffener members (224, 228, FIG. 10) at the top of the forms around the perimeter of the forms before pouring. While sufficient time passes to cure the just-poured concrete to a specified minimum strength before releasing the forms 114, 116 for the next lift, reinforcing steel ("rebar") can be placed for the next lift of concrete. Access to place reinforcing and pour concrete is provided on both sides of the evolving structural section on the work decks 110, 112. The work decks 110, 112 can be supplied with concrete and reinforcing steel, and other materials, by way of individual equipment such as mobile cranes and concrete pump trucks or, more preferably, it can be supplied with a specialized modular tower crane which is located so that the swing of the boom of the crane has sufficient access to all parts of the segment or whole structure (e.g., structure 400 of FIG. 20). Being modular in nature, the tower crane will be able to self-increment its height. At such time as the reinforcing steel for the second lift is in place and the first lift has attained adequate strength, the forms 114, 116 are released away from the cured concrete, and can also be tilted as described in association with FIG. 8 (see tilted form 116*a*). End-of-wall adapters (FIG. 22) and end-of-segment adaptors (FIG. 21) are also then released from the apparatus 100, and rotated away from the cast concrete, and any end-of-segment end plates 281 (FIG. 21) are lifted to the next level. Before raising the jump-slip system 100, the forms (114, 116) are preferably cleaned and oiled by personnel on the work-decks 110, 112 for the next lift. (Cleaning before raising the machine to the next level prevents loose concrete and oil from contaminating the cold joints.) The top edge of the cured concrete of the first lift is also cleaned of any loose concrete so that the bottom edge of the forms 114, 116 will interface cleanly with this edge and form a tight overlap. The jump-slip machine (100 of FIG. 6, or 400 of FIG. 20) can then be raised to the next level by activating the yoke jacks 272 (FIGS. 6 and 14). As the control of the system is intended to be automated, an operator can instruct a programmable logic controller ("PLC") to execute the lift, and all forms will automatically be raised to the predetermined elevation. Elevation can be monitored through an array of GPS sensors that locate the forms 114, 116 in three dimensions to thereby maintain the intended structure geometry. Following the initial lift, there will now be sufficient room between the form system (truss modules 118 and 120) and the foundation "F" to attach the attitude control modules 130, 132 (FIG. 6) using anchor flanges 178 (FIG. 8). This arrangement of mounting the attitude control modules 130, 132 immediately below the yoke module 106 provides a rigid mounting, and will result in high dimensional control of the evolving structure by the modules 130, 132. However, due to openings or obstructions in the resulting structure where the radial attitude control modules 130, 132 cannot thrust off of the structure, the attitude control modules may need to be mounted to the truss modules 118, 120 adjacent to the yoke arms 268, 270 (FIG. 14) on nearby actuator frames (frames 134, 136 of an adjacent apparatus 100), or on the end frames (138, 140, 142, 144, FIG. 7)), or on the spaces frames (146, 148, 150, 152, FIG. 7). Once the attitude control modules 130, 132 are attached, they can then be connected to the power and control system, and the PLC can be instructed to effect a full radial alignment of the jump-slip system by way of simultaneously or iteratively actuating these attitude control modules (130, 132) using actuators 260, 264 (FIG. 13). This radial alignment, in combination with the yoke-climb pipe 99 tangential or sway alignment and vertical progression (height of climb module 108), generally fully aligns the jump-slip machine in three dimensions a long the entire form perimeter. The form modules 114, 116 are then actuated back into the structure-forming position, and the bottom edge of the forms are pre-loaded against the top edge of the first concrete lift over a specified overlap distance that will not overload the just-poured concrete. Again, any block-outs or embedments can be inserted and fastened at this time, and spreaders can be attached to the form tops. Concrete is then poured again, as described above, and the discrete casting process is repeated until the full structure height is effected. Climb pipe 99 can be periodically spliced onto the existing climb pipe with threads and/or welds. Because the intended structure height may not be a precise multiple of the "effective form height" (i.e., the actual height of the forms 114, 116 minus the overlap), the final pour may be poured to only some fraction of the effective form height.

b) Continuous Casting Mode

The set-up, described above, will generally have prepared the jump-slip machine (100 of FIG. 6, 400 of FIG. 20, for example) for continuous-mode casting. Typically the jump-slip standard module pairs (102, 104) will be delivered to the construction site as described in the "set-up", above, but they will have form liners, such as plywood, attached to the form faces 114, 116 to allow a continuous release of the concrete as it is formed. Also, the extender form adaptors (such as 370. FIG. 17B) and any incremental form modules (such as 120M, 120N, 120P, 120Q of FIG. 20) and end-of-wall adapters (e.g., 282, FIG. 22) or end-of-segment form adaptors (e.g., 276, FIG. 21) will also have form liners. During the set-up, the forms 114, 116 will have been actuated into a format that is relieved downward (i.e., the tops of forms 114 and 116 will be slightly tilted towards one another, opposite of the direction of tilt indicated by form 116*a* in FIG. 9). This will allow a smooth transition of the form past the concrete, which will be in various stages of setting-up and curing as the structure is being formed. As with the discrete casting mode described above, prior to pouring concrete any block-outs or embedments are placed within the forms and fastened to the form faces 114, 116 in the first form height. Unlike the discrete casting mode, in continuous casting operation subsequent block-outs or embedments can be inserted in between the forms 114, 116 amongst the continuous process of installing rebar and pouring concrete. Continuous casting is initiated with the pouring of nearly the full form height, and any final geometric changes to the structural width are made at this time while the concrete is in a fluid state by moving the individual strut actuators 196, 198 in or out using actuators 200, and, to a limited extent, moving the strut actuators in or out relative to the actuator shafts 184, 186, 188, 190 by actuating the actuators 196 and/or 198. Reinforcing ("rebar") is installed essentially continuously and simultaneously with the pouring of concrete. The reinforcing progression should stay above the forms 114, 116 a sufficient distance to allow inspection of the reinforcing before it is cast in concrete. In an automatic control mode, the PLC can be pre-set to activate simultaneously all yoke jacks 272 to effect a continuous upward progression of the jump-slip system 100 at a predetermined rate, which can be modified at any time to slow-down or speed-up the casting process to match the rate at which the personnel are installing the reinforcing and concrete, or depending on variances in concrete curing times. As the jump-slip system gets high enough off the foundation, the radial attitude control modules 130, 132 can be attached (as described above) and connected to the power and control system. The radial attitude control modules 130, 132 can then become an active part of the PLC-controlled alignment system and, together with the tangential control and elevation control, they can continuously maintain the jump-slip system 100 in the predetermined geometry within the allowed tolerances. When the height of the evolving structure permits, fixed or trolley-type swing scaffolds can be attached to the actuator frames (174, 176, FIG. 8) and the end frames (138, 140, 142, 144, FIG. 7) to allow any required finishing of the slip-formed concrete surface. The continuous casting process then proceeds as described above until the desired structure height is achieved. As with discrete casting mode, climb pipe segments 99 are periodically spliced on to the previous climb pipe to maintain the yoke jacks 272 with a climb member to effect vertical or near vertical progression of the apparatus 100.

IV) Take-Down

After the concrete structure has been formed, the jump-slip form system (comprising a plurality of connected apparatus 100, or variations thereof such as corner forming apparatus 300A of FIG. 20) can then be lifted down from the completed reinforced concrete segment (or the completed whole structure) in module chains with a mobile crane or specialized tower crane. Near the ground the radial alignment control modules (130, 132) and any swing scaffolds are preferably removed from the truss modules 118 and 120. Then the yokes 106 can be lifted to the ground. The protruding climb pipes 99 can then be cut off flush with (or recessed into) the formed structure and patched over. The remainder of the take-down is essentially the reverse of "set-up", described above.

Figure 24:
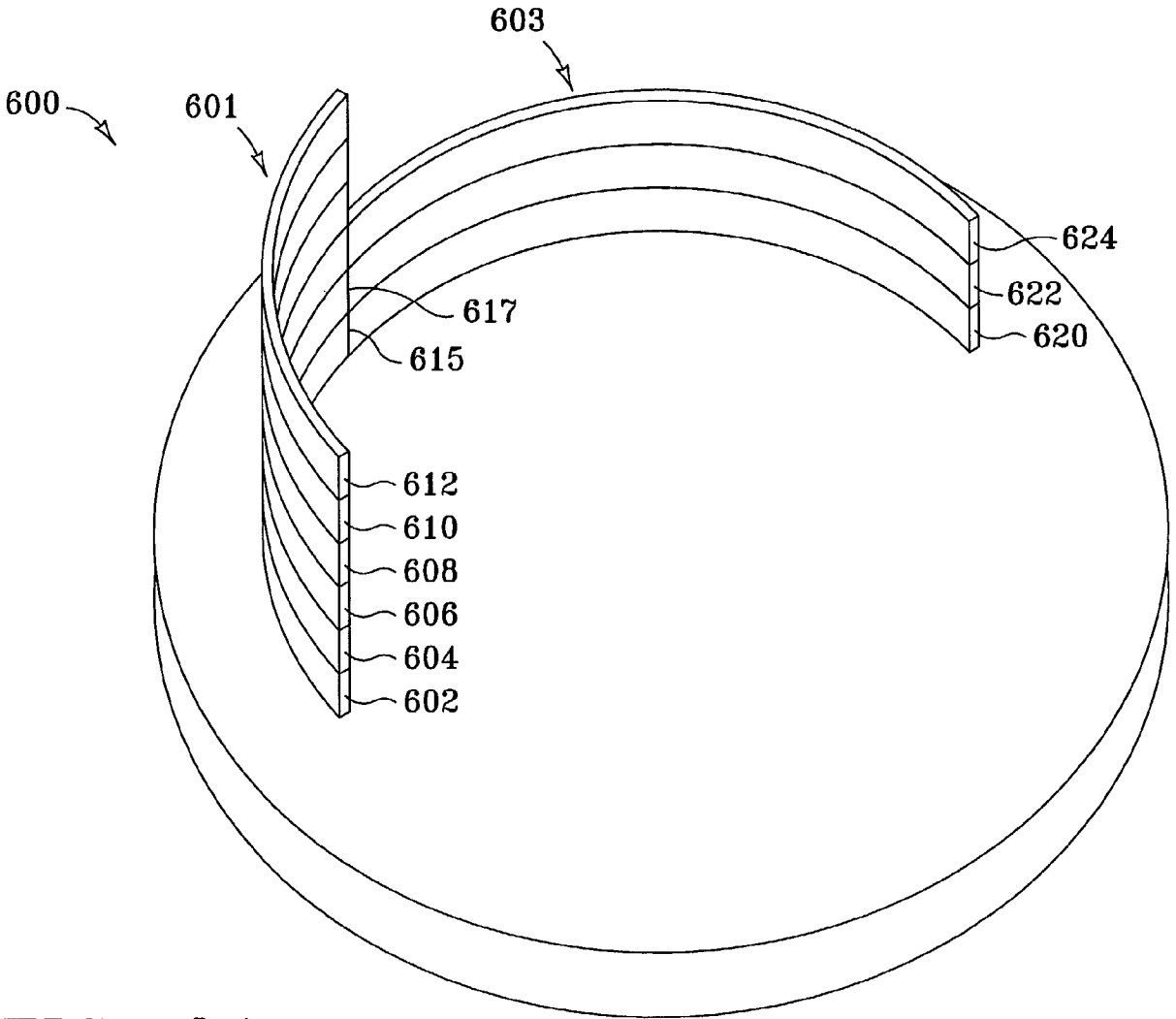
FIG. 24 depicts a method of segmentally forming a generally vertical concrete structure in accordance with the present invention.

As can be seen by the foregoing description, the invention can further include a method of segmentally forming an essentially vertical concrete structure (such as structure 600 of FIG. 24). The method includes providing a segment-section form which defines a concrete-receiving section. The segment-section form comprises a first face-form (e.g., form 114 of FIG. 6) and a second face-form (e.g., form 116 of FIG. 6) placed in generally parallel, spaced-apart juxtaposition to one another. As indicated by FIG. 17, the face-forms 114 and 116 can be in a curvilinear relationship to one another. The segment-section further includes a first segment-section end-form (e.g., 280, FIG. 21, or 284, FIG. 22) and second segment-section end-form. As indicated by FIGS. 21 and 22, the segment-section end forms are placed in spaced-apart relationship to one another, and are placed essentially perpendicular to, and between, the face-forms 114 and 116. The method further includes depositing liquid concrete in the concrete-receiving section, and allowing the liquid concrete to cure to a self-supporting solid state, to thereby form a first-segment (601) first-section (602) defined by a first end (615). The method then includes moving the segment-section form upward above the first-segment first-section (602), depositing liquid concrete in the concrete-receiving section, and allowing the liquid concrete in the concrete-receiving section to cure to a self-supporting solid state, to thereby form a first-segment (601) second-section (604) defined by a second end (617). The method can further include repositioning the segment-section form adjacent the first-segment first-section first end (615), depositing liquid concrete in the concrete-receiving section, and allowing the liquid concrete in the concrete-receiving section to cure to a self-supporting solid state, to thereby form a second-segment (603) first-section (620). It should be noted that the second-segment first-section 620 can be formed before the first segment (601) second section (604) is formed. The order in which the sections of the segments is formed will be dictated by the efficiencies and economies of moving the segment-section form from the first segment (601) to the second segment (602), versus moving the segment-section form upwards from the first section (602 or 620) to the second section (respectively, 604 or 622).

The method can further include moving the segment-section form upward above the first-segment second-section (604), and then depositing liquid concrete in the concrete-receiving section. The liquid concrete in the concrete-receiving section is then allowed to cure to a self-supporting solid state, to thereby form a first-segment third-section (606). As can be observed, the segment-section form can be continually moved upward from the first-segment third-section 606 to form first-segment fourth section (608), first-segment fifth section (610), first-segment sixth section (612), and so on. Further, the method can further include moving the segment-section form upward above the second-segment first-section (620), and then depositing liquid concrete in the concrete-receiving section. The liquid concrete in the concrete-receiving section is then allowed to cure to a self-supporting solid state, to thereby form a second-segment second-section (622). As can be observed, the segment-section form can be continually moved upward from the second-segment second-section 622 to form second-segment third-section (624), and so on. The order in which segments (601, 603) are formed is only relevant insofar as each additional section of each segment necessarily needs to be formed on top of the previously formed section for that segment. That is, first-segment first-section 602 can be first formed, then second-segment first section 620; thereafter either first-segment second-segment 604 can be formed, or second-segment second-section 622 can be formed.

When a climb-rod (such as 99 of FIG. 6) is provided, and the segment-section form is guided by the climb rod (as described above with respect to attitude control modules 130, 132, for example), the method can further include adjusting the position of the segment-section form relative to the climb rod prior to depositing the liquid concrete for a subsequent section in a segment on top of a prior section in the segment (e.g., before depositing concrete for section 604 on top of section 602).

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. An apparatus for forming concrete structures, comprising:

a first and a second truss module;

a first and a second concrete form;

a first and a second actuator device, each said actuator device mounted on the respective first and second truss module and configured to translationally move the respective first and second form with respect to the respective truss module;

a yoke connecting the first truss module to the second truss module to place the concrete forms in generally parallel, spaced-apart relationship;

a climbing device attached to the yoke and configured to engage a climb rod and to move the apparatus along the climb rod; and and attitude positioner supported by the first truss module and configured to contact a portion of an evolving concrete structure formed by the apparatus; and an attitude control actuator configured to move the attitude positioner with respect to the first truss module.

2. The apparatus of claim 1, and further comprising an attitude control frame, and wherein the attitude control actuator is supported on the attitude control frame and is configured to move the attitude positioner with respect to the attitude control frame.

3. The apparatus of claim 1, and wherein each truss module further comprises a work deck supported thereon.

4. An apparatus forming concrete structures, comprising:

a first and a second truss module;

a first and a second concrete form;

a first and a second actuator device, each said actuator device mounted on the respective first and second truss module and configured to translationally move the respective first and second form with respect to the respective truss module;

a yoke connecting the first truss module to the second truss module to place the concrete form in generally parallel, spaced-apart relationship;

a climbing device attached to the yoke and configured to engage a climb rod and to move the apparatus along the climb rod; and wherein:

each truss module further comprises a work deck supported thereon;

each work deck comprises a plurality of under-deck plates placed on each truss module in spaced-apart relationship, and a plurality of over-deck plates bridging the spaced-apart under-deck plates; and the under-deck plates and the over-deck plates are supported by the truss modules in a manner which allows relative movement between the under-deck plates and the over-deck plates.

5. An apparatus forming concrete structures, comprising:

a first and a second truss module;

a first and a second concrete form;

a first and a second actuator device, each said actuator device mounted on the respective first and second truss module and configured to translationally move the respective first and second form with respect to the respective truss module;

a yoke connecting the first truss module to the second truss module to place the concrete form in generally parallel, spaced-apart relationship;

a climbing device attached to the yoke and configured to engage a climb rod and to move the apparatus along the climb rod; and a yoke adjustment device positioned between the yoke and one of the truss modules to thereby allow the climbing device to be aligned to a predetermined reference point.

6. An apparatus forming concrete structures, comprising:

a first and a second truss module;

a first and a second concrete form;

a first and a second actuator device, each said actuator device mounted on the respective first and second truss module and configured to translationally move the respective first and second form with respect to the respective truss module;

a yoke connecting the first truss module to the second truss module to place the concrete form in generally parallel, spaced-apart relationship; and a climbing device attached to the yoke and configured to engage a climb rod and to move the apparatus along the climb rod, and wherein:

the first and second forms are semi-flexible to allow the forms to be urged from a flat shape into a curvilinear shape;

the first and second actuator devices are form-translating actuators, the apparatus further comprising:

a first and a second form shaping device, each said form shaping device comprising:

a form shaping actuator mounted on the respective truss module;

a form shaping member having a first end connected to the respective form, and a second end connected to the form shaping actuator; and wherein the form shaping actuator is configured to move the second end of the form shaping member relative to the respective truss module, urging the form into a curvilinear shape.

7. The apparatus of claim 6, and wherein the form shaping members comprise adjustable-length struts.

8. The apparatus of claim 6, and wherein:

the first and second form-translating actuators each comprise a threaded shaft connected to the respective form, and received within a first screw jack supported in the respective truss module in a fixed position;

the form shaping actuators each comprise a second screw jack which receives the threaded shaft, and which is slidably supported in the respective truss module.

9. The apparatus of claim 6, and wherein each truss module comprises:

a first and a second space frame;

an actuator frame supporting the respective the first and second form-translating actuators, the actuator frame being positioned between the space frames; and wherein the space frames are attached to the actuator frame in an articulable manner.

10. The apparatus of claim 9, and wherein each space frame comprises adjustable length links.

11. An apparatus for forming concrete structures, comprising:

two opposed concrete form modules which together are configured to provide a form for liquid concrete;

a first and a second truss module, each truss module comprising:

an articulable space frame;

an actuator member having a first end connected to one of the concrete form modules;

a form shape-altering actuator supported within the actuator frame, the form shape-altering actuator moveably engaging the actuator member;

a plurality of extensible struts, each strut having a first end attached to one of the form modules, and a second end attached to the actuator; and a yoke connecting the first truss module to the second truss module.

12. The apparatus of claim 11, and wherein the articulable space frame comprises adjustable length links.

13. The apparatus of claim 11, and further comprising a work deck supported on at least one of the truss modules, the work deck comprising a plurality of overlapping, articulable deck plates.

14. A concrete forming module, comprising:

a semi-flexible concrete form;

an actuator frame;

a form shaping actuator supported by the actuator frame;

an elongated form anchoring member having a first end connected to the form at an anchor point, the form anchoring member being connected to the actuator frame;

a form shaping member having a first end connected to the form, and a second end connected to the form shaping actuator; and wherein the form shaping actuator is configured to produce relative movement between the second end of the form shaping member and the anchor point to thereby urge the form into a curvilinear shape.

15. The concrete forming module of claim 14, and wherein the form shaping actuator is configured to move within the actuator frame to effect movement of the second end of the form shaping member relative to the anchor point.

16. The concrete forming module of claim 14, and wherein the form shaping actuator is configured to move the elongated anchor member relative to the actuator while the actuator remains stationary, to effect movement of the second end of the form shaping member relative to the anchor point.

17. The concrete forming module of claim 15, and wherein the form shaping member comprises an adjustable-length strut.

18. An apparatus for forming concrete structures, comprising:

a first form and a second form placed in generally parallel, spaced-apart relationship with one another;

a yoke comprising a first arm and a second arm; and a first-form-shaping member having a first end connected to the first form and a second end in moveable relationship to the yoke first arm.

19. The apparatus of claim 18, and further comprising a second-form-shaping member having a first end connected to the second form and a second end in moveable relationship to the yoke second arm.

20. The apparatus of claim 18 and further comprising a first-form-shaping actuator configured to move the second end of the first-form-shaping member relative to the yoke first arm.

21. The apparatus of claim 18 and wherein the first-form shaping member comprises an adjustable-length strut configured to move the first end of the first-form-shaping member relative to the yoke first arm.

* * * * *